US012012710B1

(12) United States Patent
Burkett et al.

(10) Patent No.: US 12,012,710 B1
(45) Date of Patent: Jun. 18, 2024

(54) SEAWALL

(71) Applicants: Glenn Burkett, Cobourg (CA); Ian Anderson, Haliburton (CA)

(72) Inventors: Glenn Burkett, Cobourg (CA); Ian Anderson, Haliburton (CA)

( * ) Notice: Subject to any disclaimer, the term of this patent is extended or adjusted under 35 U.S.C. 154(b) by 127 days.

(21) Appl. No.: 17/690,394

(22) Filed: Mar. 9, 2022

(51) Int. Cl.
*E02B 3/06* (2006.01)
*E02D 29/02* (2006.01)

(52) U.S. Cl.
CPC ..... *E02B 3/066* (2013.01); *E02D 29/0233* (2013.01); *E02D 29/0266* (2013.01)

(58) Field of Classification Search
CPC ..... E02B 3/066; E02B 3/14; E02D 29/0233; E02D 29/0266; E02D 2250/0023; E02D 2600/20
See application file for complete search history.

(56) References Cited

U.S. PATENT DOCUMENTS 4,924,641 A * 5/1990 Gibbar, Jr. ..... E04B 2/8652 52/258
5,024,035 A * 6/1991 Hanson ..... E04B 2/18 52/591.1
6,037,538 A * 3/2000 Brooks ..... H02G 3/288 174/498
6,164,035 A * 12/2000 Roberts ..... E04B 1/14 52/745.1
6,189,282 B1 * 2/2001 VanderWerf ..... E04B 2/14 52/582.1
7,971,407 B2 * 7/2011 MacDonald ..... E04C 1/395 52/568
9,528,263 B2 * 12/2016 Lightfoot ..... E04B 2/02
10,781,588 B1 * 9/2020 Nadeau ..... E04C 5/163
2004/0020144 A1 * 2/2004 Sanders ..... E04C 3/34 52/223.7
2007/0079566 A1 * 4/2007 Neill ..... E04B 2/46 52/425
2007/0193129 A1 * 8/2007 Mansfield ..... E02B 3/066 52/79.9
2017/0218622 A1 * 8/2017 Manthei ..... B28B 7/364
2019/0003142 A1 * 1/2019 Neiman ..... E02D 5/54

* cited by examiner

*Primary Examiner* — Carib A Oquendo
(74) *Attorney, Agent, or Firm* — Gulf Coast Intellectual Property Group

(57) ABSTRACT

A seawall constructed to provide an improved installation method and further provide a more resistant structure wherein the elements of the present invention are combined with an ultra high performance concrete to create the seawall of the present invention. The seawall includes a plurality of wall panel members wherein the wall panel members have a plurality of cells formed therein wherein the cells are hollow and extend between the upper edge and lower edge of the wall panel member. Wall panel connection members are configured to mateably couple adjacent wall panel members. The present invention further includes piling members configured to be journaled into the cells of the wall panel members and penetrate the ground underneath the wall panel member. A sub-cap member is superposed the wall panel member and is integrally formed therewith subsequent pouring of concrete. A top cap member is operably coupled to the sub-cap member.

11 Claims, 22 Drawing Sheets

SEAWALL

FIELD OF THE INVENTION

The present invention relates generally to marine-land barriers, more specifically but not by way of limitation, a seawall that is configured to be constructed employing a plurality of elements and techniques that facilitates a secure and cost effective installation wherein the present invention further utilizes materials such as but not limited to ultra-high performance concrete and fiber reinforced polymers.

BACKGROUND

Seawalls are a structure that is installed as a form of defense constructed in coastal areas where the sea directly impacts the landforms. There are several different types of seawalls that are commonly constructed and they are chosen based on the reflection of forces to which they will be subjected as well as the cost associated for each type. Depending on the type of seawall construction inevitably there will be problems and failures based upon the conditions to which they are subjected, construction techniques and components thereof. One issue is anchor rod deterioration wherein prolonged exposure to saltwater and other elements can cause anchor rod failure, which leads to seawall misalignment and outward movement.

Another issue with conventional seawall construction is the issue with seawall cap failure. Exposure to saltwater and other elements can cause the steel utilized for reinforcing the concrete seawall cap to corrode, which causes expansion. This results in the development of cracks, which eventually leads to the breaking off of large pieces of the seawall cap. The loss of concrete and exposure of the corroding reinforcing steel weakens the seawall cap significantly leads to further seawall misalignment and other structural issues. In addition to the aforementioned issues, there are disadvantages to conventional seawall construction that result in a more costly and timely installation.

Accordingly, there is a need for a seawall and construction thereof that facilitates a cost effective installation thereof and further provides improved construction techniques so as to provide a superior seawall.

SUMMARY OF THE INVENTION

It is the object of the present invention to provide a seawall that is configured with a plurality of elements facilitating an improved installation and a durable seawall wherein the present invention includes a plurality of wall panels being operably coupled with wall panel connection members.

Another object of the present invention is to provide a seawall that is installed so as to protect a landform from marine conditions wherein the present invention includes a piling member that is inserted into some cells of the wall panel and driven downwards so a portion thereof is deeper that the bottom of the wall panel.

A further object of the present invention is to provide a seawall that is configured with a plurality of elements facilitating an improved installation and a durable seawall wherein some of the cells of the wall panels have disposed therein pour plugs wherein the pour plugs are secured utilizing chemical adhesion.

Still another object of the present invention is to provide a seawall that is installed so as to protect a landform from marine conditions wherein the present invention wherein the wall panels have superposed thereto sub-cap sections wherein the sub-cap sections are secured utilizing chemical adhesion.

An additional object of the present invention is to provide a seawall that is configured with a plurality of elements facilitating an improved installation and a durable seawall wherein the sub-cap section includes pour blocks wherein the pour blocks are located at the ends of the sub-cap sections and are secured utilizing chemical adhesion.

Yet a further object of the present invention is to provide a seawall that is installed so as to protect a landform from marine conditions wherein the present invention wherein the wall panels further include tie back rods that are secured utilizing high strength adhesive.

Another object of the present invention is to a provide a seawall that is configured with a plurality of elements facilitating an improved installation and a durable seawall wherein ensuing installation of the sub-cap sections the wall panels and sub-cap section are filled with ultra high performance concrete.

An alternate object of the present invention is to provide a seawall that is installed so as to protect a landform from marine conditions wherein the present invention further includes a top cap member that is placed ensuing the pour of ultra high performance concrete but prior to the curing thereof.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
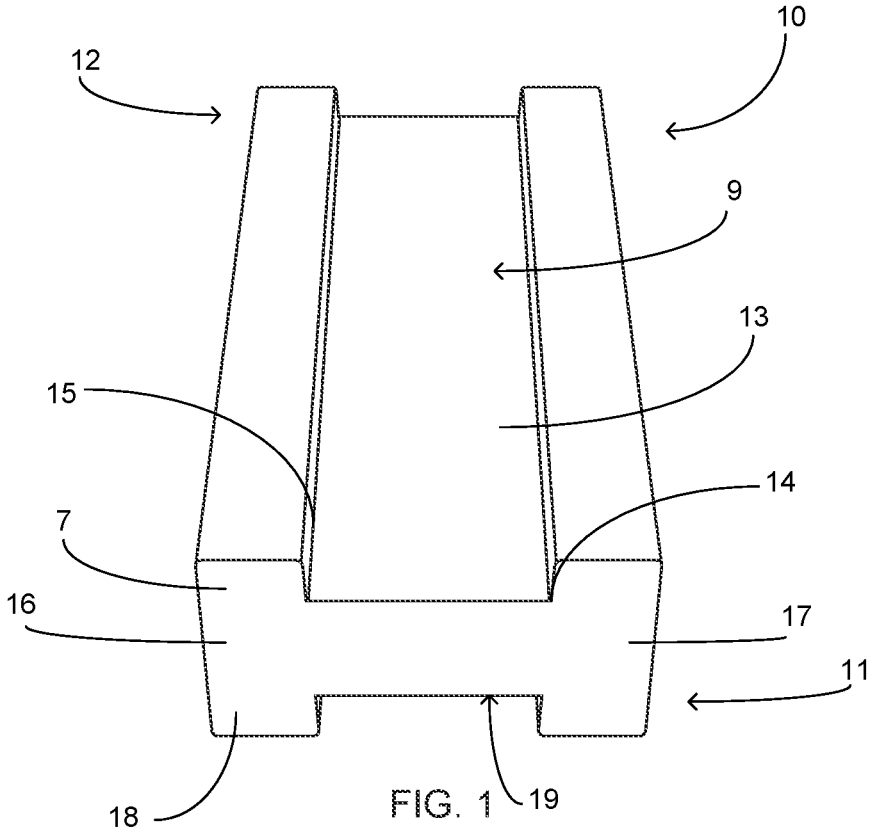
FIG. 1 is a top perspective view of a wall connection spline of the present invention.

Referring now to the drawings submitted herewith, wherein various elements depicted therein are not necessarily drawn to scale and wherein through the views and figures like elements are referenced with identical reference numerals, there is illustrated a seawall 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
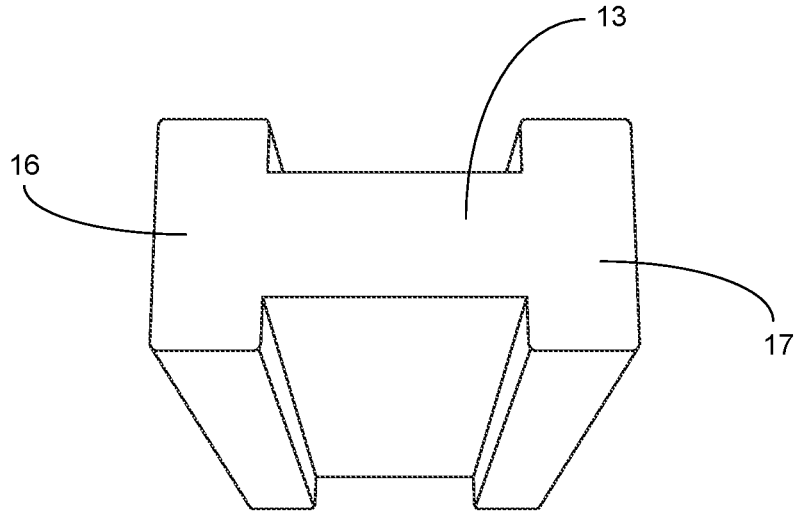
FIG. 2 is an end perspective view of a wall connection spline of the present invention.

Now referring in particular to the Figures submitted herewith, the seawall 100 includes a plurality of wall panel connection members 10 illustrated herein in FIGS. 1 and 2. In a preferred embodiment of the seawall 100 the components thereof discussed herein are manufactured from a material such as but not limited to ultra-high performance concrete or fiber reinforced polymer. It should be understood within the scope of the present invention that alternate materials could be utilized in conjunction with or in place of the aforementioned. The wall panel connection members 10 are manufactured from a durable rigid material such as but not limited to concrete and are configured to operably couple adjacent wall panel members 20 during installation of the seawall 100. The wall panel connection member 10 includes a first end 11 and second end 12. Wall panel connection member 10 includes a center portion 13 having opposing longitudinal lateral edges 14, 15. Integrally formed with the opposing longitudinal lateral edges 14, 15 are the first lateral support member 16 and second lateral support member 17. The first lateral support member 16 and the second lateral support member 17 are perpendicular to the center portion 13. The first lateral support member 16 includes a portion 7 that extends above the upper surface 9 of the center portion 13 and further includes a portion 18 that extends below the lower surface 19 of the center portion 13. The second lateral support member 17 is identically constructed as the first lateral support member 16 creating the distinct H-shape of the wall panel connection member 10. This shape facilitates the operable coupling of adjacent wall panel members 20 as is further discussed herein. It should be understood within the scope of the present invention that the wall panel connection member 10 could be manufactured in alternate lengths so as to be the required length depending upon the height of the wall panel members 20. While a preferred shape is illustrated herein, it is contemplated within the scope of the present invention that the wall panel connection members 10 could be formed in alternate shapes so as to mateably couple adjacent wall panel members 20.

Figure 3:
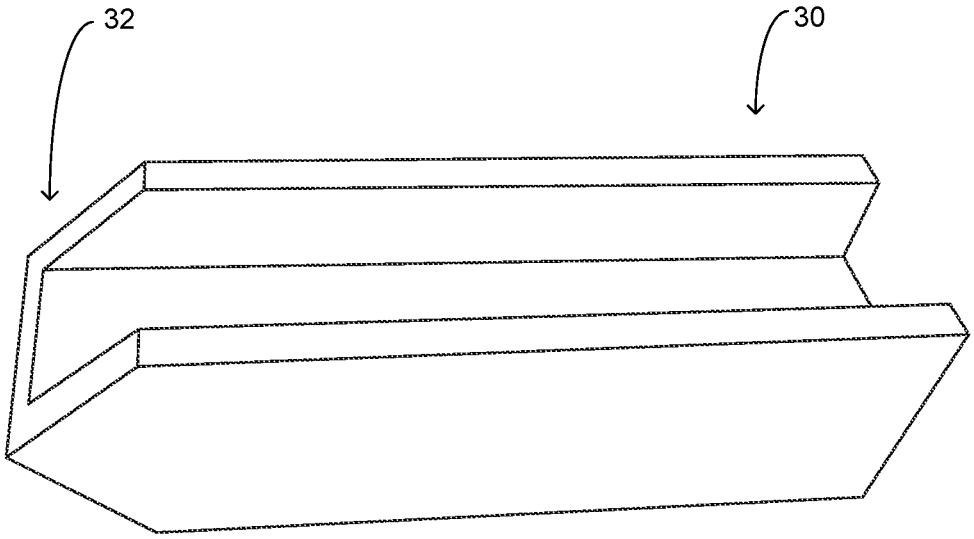
FIG. 3 is a side perspective view of a wall support piling of the present invention.
Figure 4:
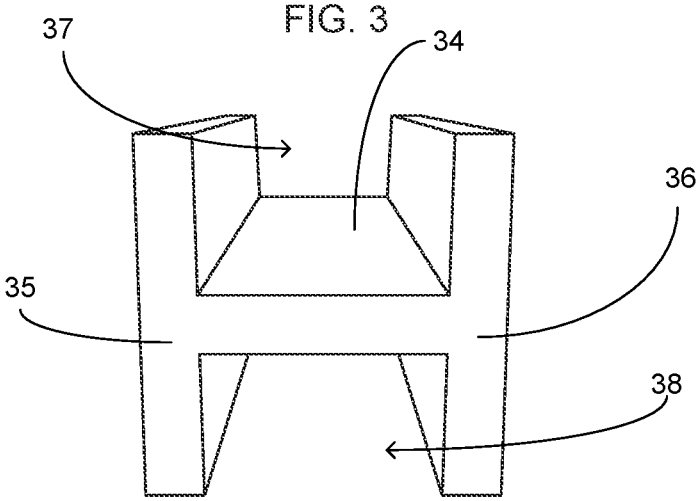
FIG. 4 is an upper end view of a wall support piling of the present invention.
Figure 5:
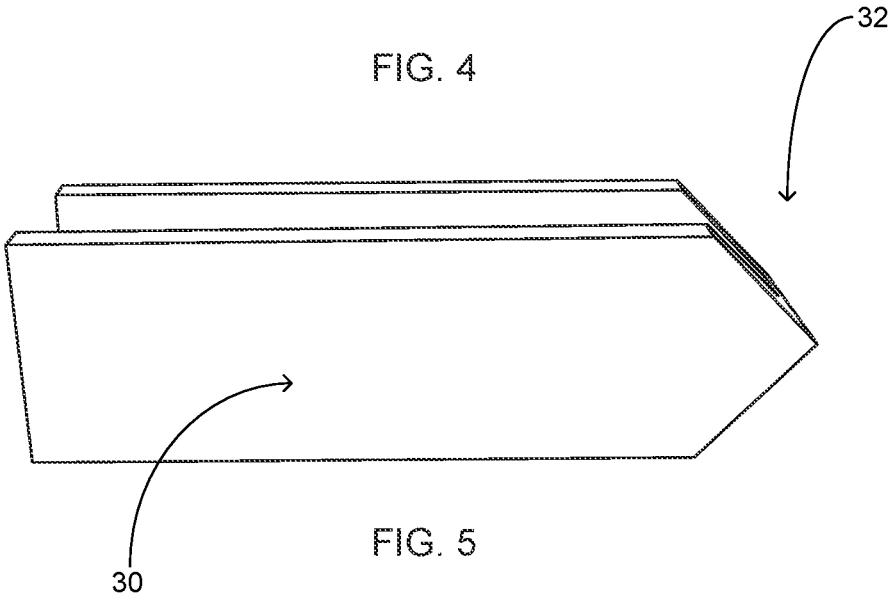
FIG. 5 is a side view of a wall support piling of the present invention.
Figure 6:
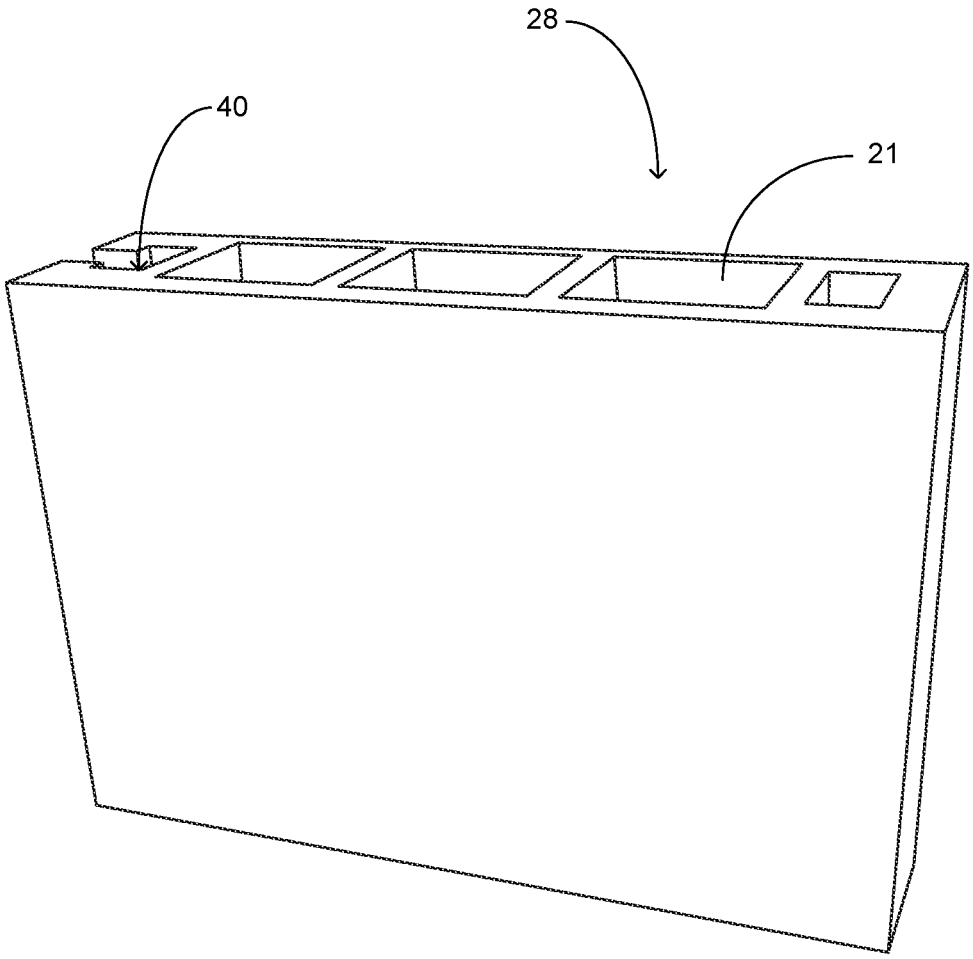
FIG. 6 is a perspective view of a wall panel of the present invention.
Figure 7:
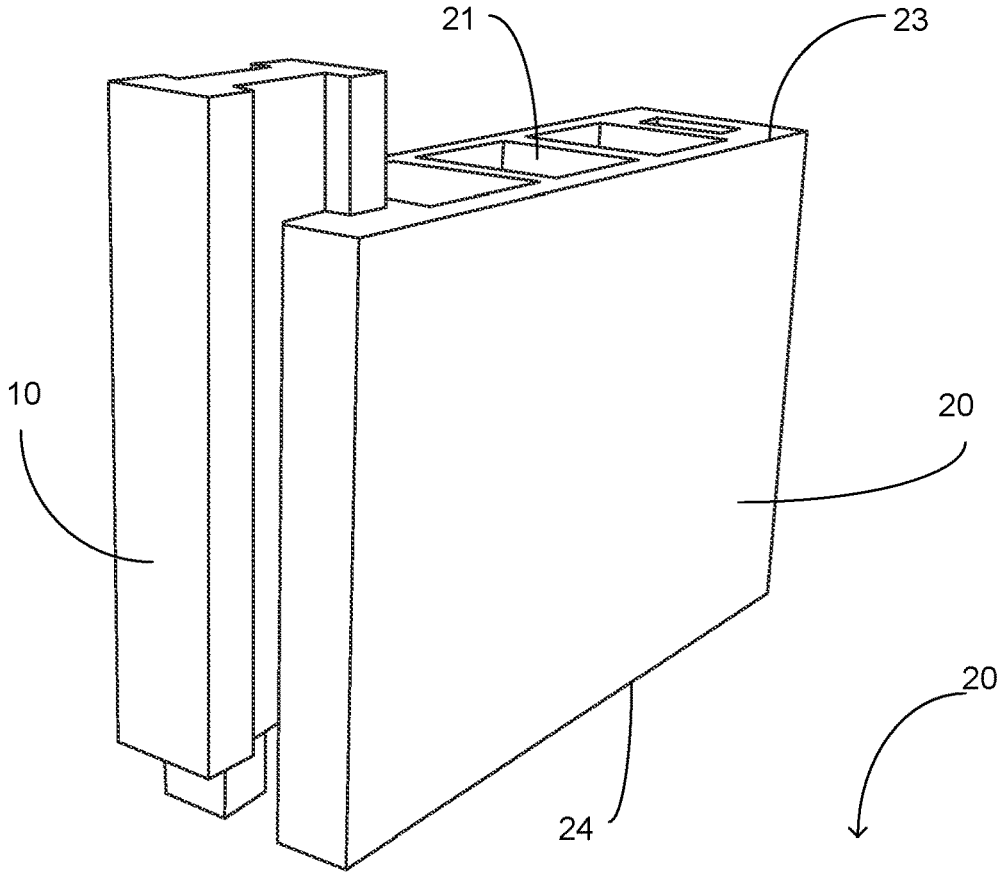
FIG. 7 is an end perspective view of a wall panel with a wall panel connection spline engaged therewith.
Figure 8:
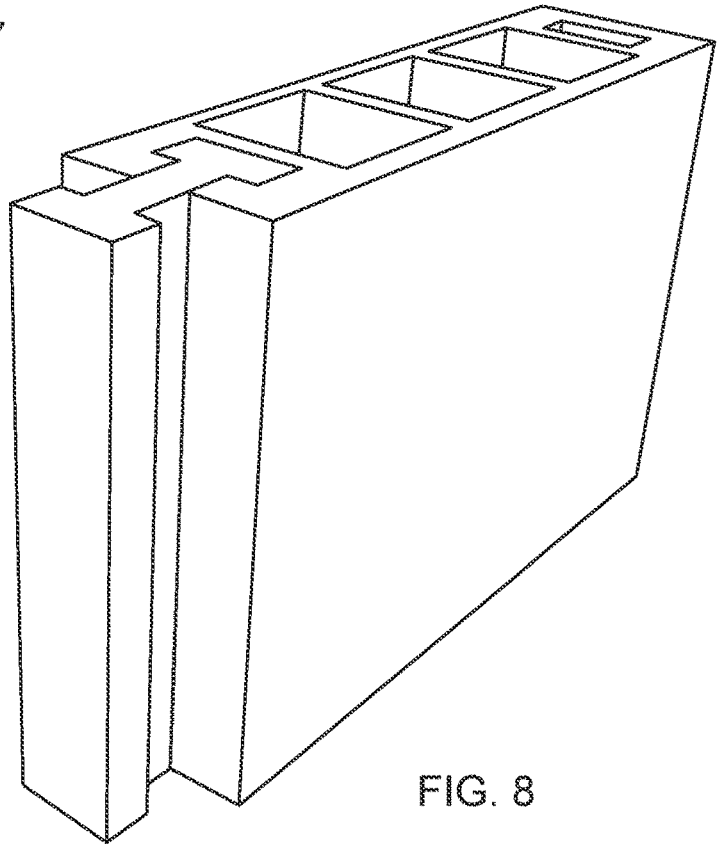
FIG. 8 is an end perspective view of a wall panel with a wall panel connection spline engaged therewith.
Figure 9:
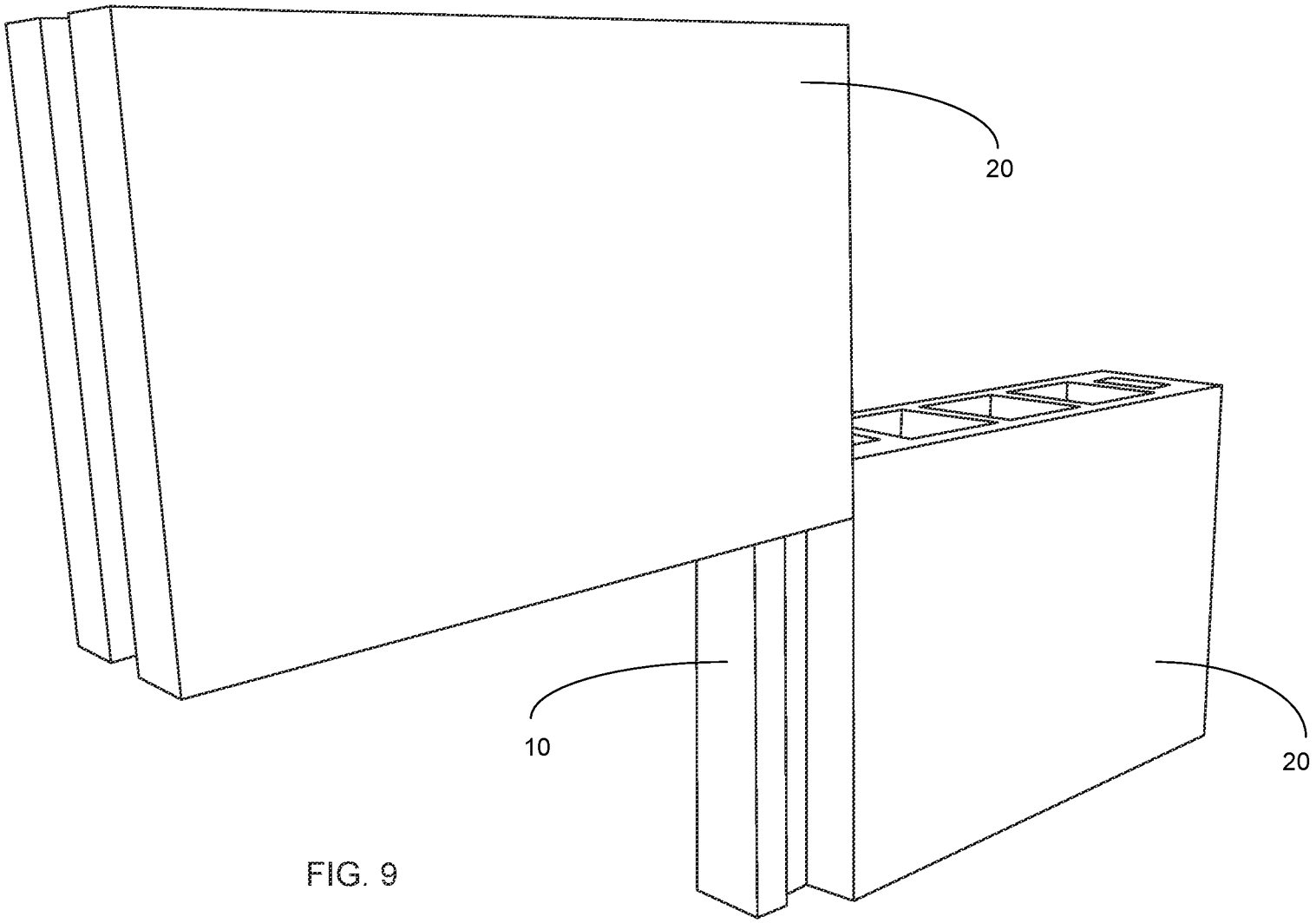
FIG. 9 is a side perspective view of two adjoining wall panels of the present invention.
Figure 10:
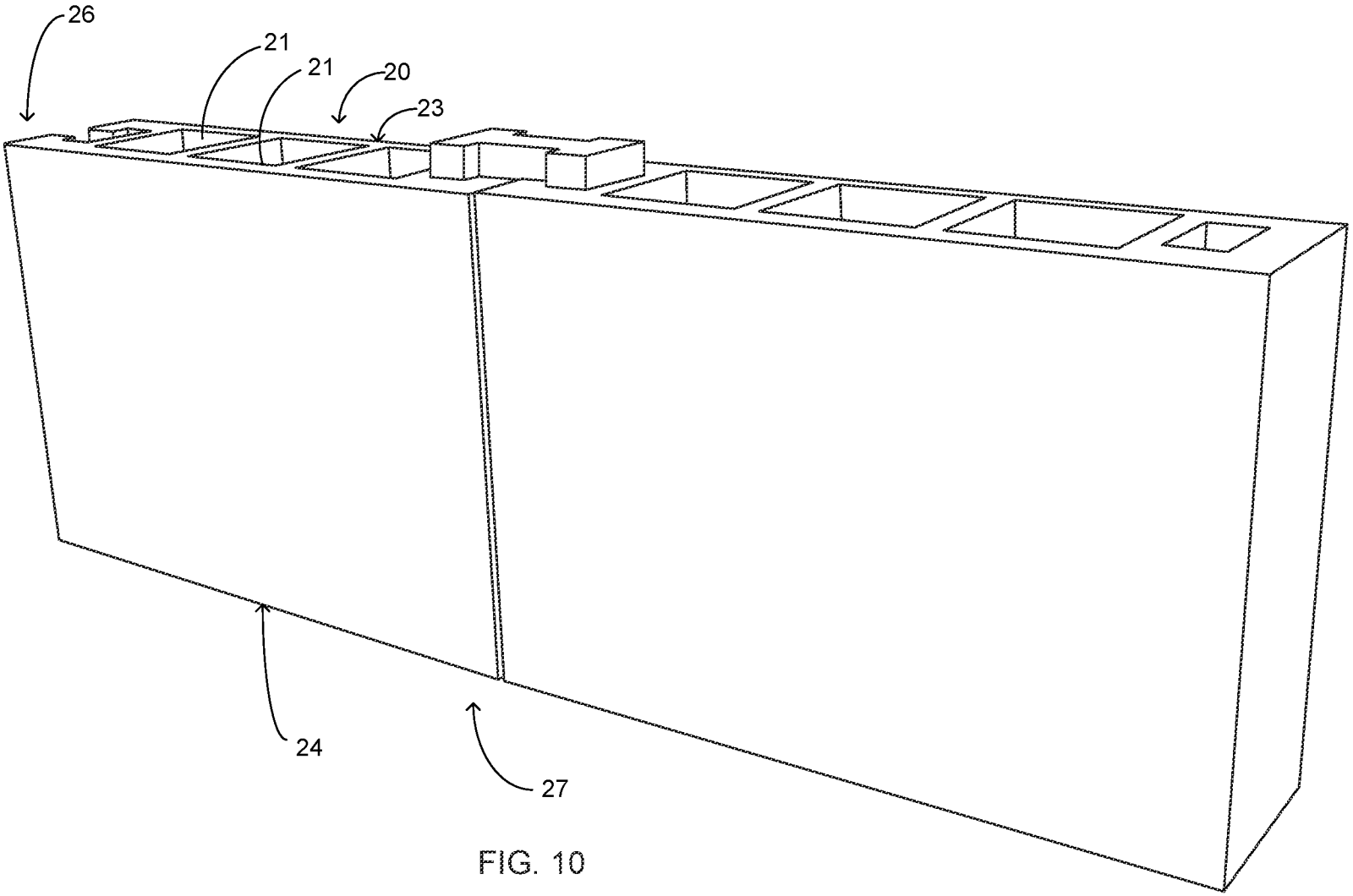
FIG. 10 is a side perspective view of two adjoining wall panels being operably coupled with a wall connection spline.

Illustrated herein in FIGS. 3 through 5 is the piling member 30 of the present invention. The piling member 30 is configured to be inserted into some of the cells 21 of the wall panel members 20 so as to provide anchoring into the ground. The piling member 30, specifically the lower end 32 thereof will extend beyond the lower edge 22 of the wall panel member 20 and into the ground of sufficient depth to achieve the desired objective of securing the wall panel member 20 in position in accordance with building code requirements. The lower end 32 of the piling member 30 is tapered in form to facilitate improved penetration into the ground. The piling member 30 includes a center section 34 being integrally formed with a first lateral member 35 and a second lateral member 36. The first lateral member 35 and the second lateral member 36 are perpendicular to the center section 34. The perpendicular orientation of the first lateral member 35 and second lateral member 36 creates a first void 37 and a second void 38. The presence of the first void 37 and the second void 38 allows a space to remain in the cell 21 subsequent to the piling member 30 being inserted into the cell 21. The first void 37 and second void 38 are filled with ultra high performance concrete towards the end of the installation of the seawall 100 and the presence first void 37 and second void 38 provides an improved structural integrity of the seawall 100 through allowance of ultra high performance concrete to be filled therein. It should be understood within the scope of the present invention that ultra high performance concrete is defined as having a minimum compressive strength of seventeen thousand pounds of pressure per square inch.

Figure 11:
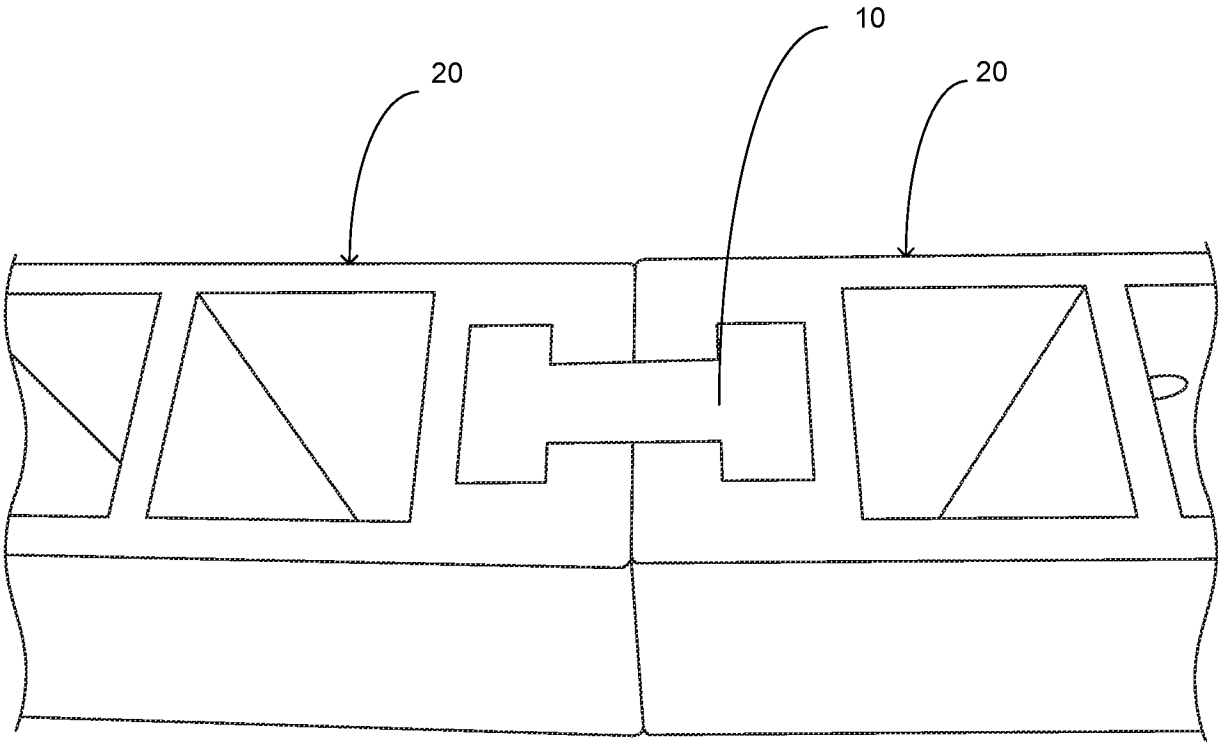
FIG. 11 is a top view of adjoining wall panels operably coupled with a wall connection spline.
Figure 12:
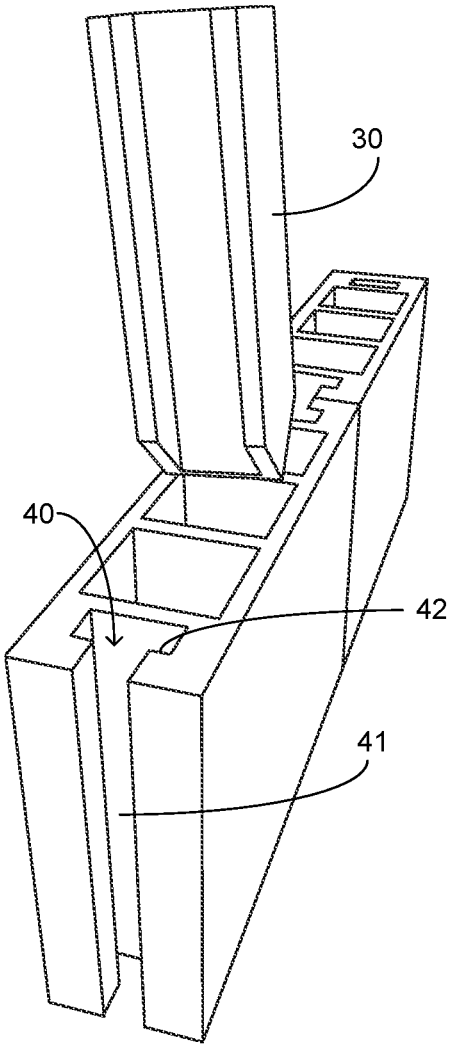
FIG. 12 is a top perspective view of a wall support piling being inserted into a wall panel.
Figure 13:
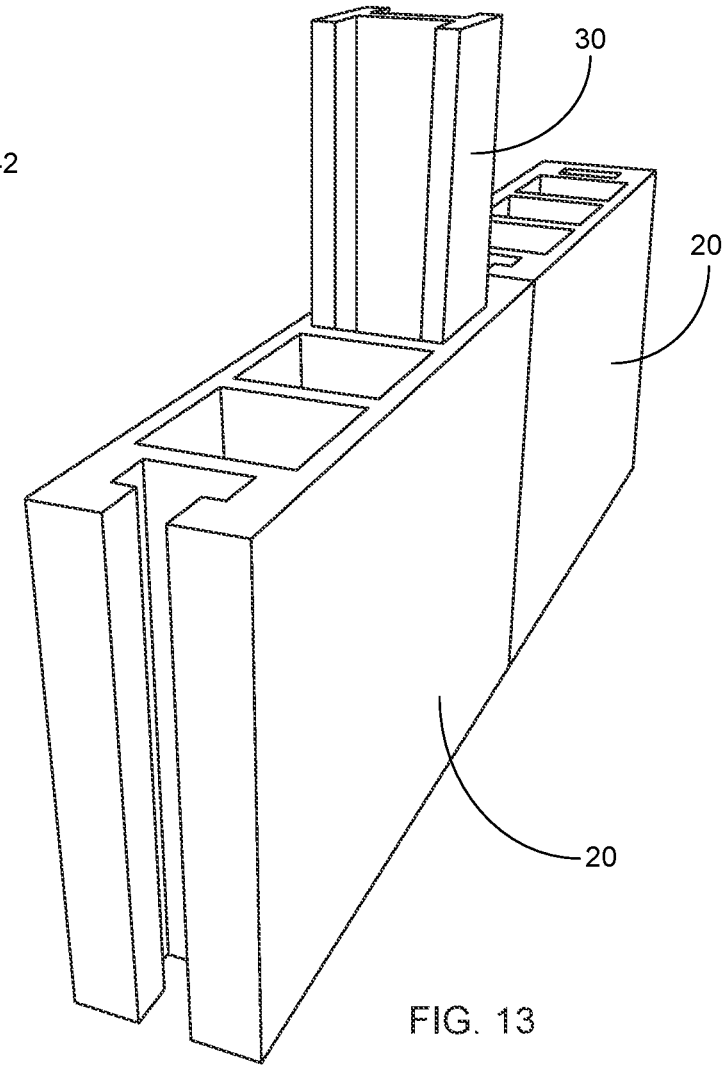
FIG. 13 is a top perspective view of a wall support piling being inserted into a wall panel.
Figure 14:
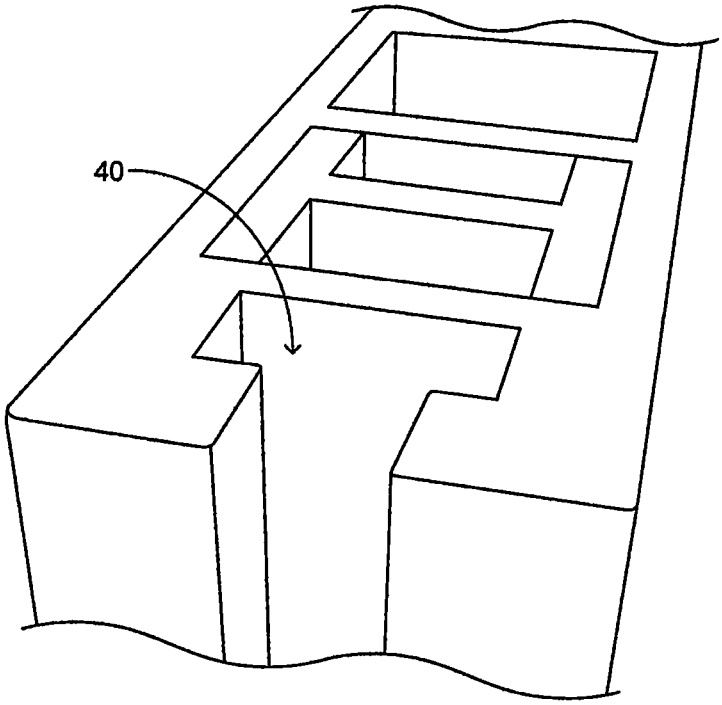
FIG. 14 is a top perspective view of a wall support piling fully inserted into a wall panel.

The seawall 100 includes utilization of wall panel members 20. It should be understood within the scope of the present invention that the seawall 100 could employ alternate quantities of wall panel members 20 depending upon the length of the installation of the seawall 100. There are slight variations in the wall panel members 20 most notably an end wall panel member 28 wherein the end wall panel member 28 only has one connection void 40 on an end thereof. The wall panel member 20 includes a plurality of cells 21 wherein the cells 21 extend intermediate the upper edge 23 and lower edge 24. The cells 21 are hollow so as to be filled with ultra high performance concrete towards the end of the installation process of the seawall 100. The cells 21 are square in shape so as to be mateable with the piling member 30 but it should be understood within the scope of the present invention that the cells 21 could be formed in alternate shapes so as to accommodate a piling member 30 of a similar shape. The wall panel members 20 include a first end 26 and a second end 27. Formed on the ends of the wall panel members 20 is the connection void 40. The connection void 40 includes a center section 41 and a cross section 42 that are integrally formed to create the connection void 40. The connection void 40 extends intermediate the upper edge 23 and lower edge 24. Cross section 42 is perpendicular to center section 41 forming a T-shape for the connection void 40. The T-shape of the connection void 40 provides a mateable coupling to the wall panel connection member 10 as illustrated herein in FIG. 11. Adjacent wall panel members 20 are operably coupled subsequent being placed end to end wherein the connection voids 40 of each wall panel member 20 are aligned and a wall panel connection member 20 is inserted into each connection void 40 of the adjacent wall panel members 20. It should be understood within the scope of the present invention that the connection void 40 could be formed in alternate shapes so as to mateably couple with a wall panel connection member 10 of a similar shape. It should also further be understood within the scope of the present invention that the wall panel member 20 could have alternate quantities of cells 21.

Figure 15:
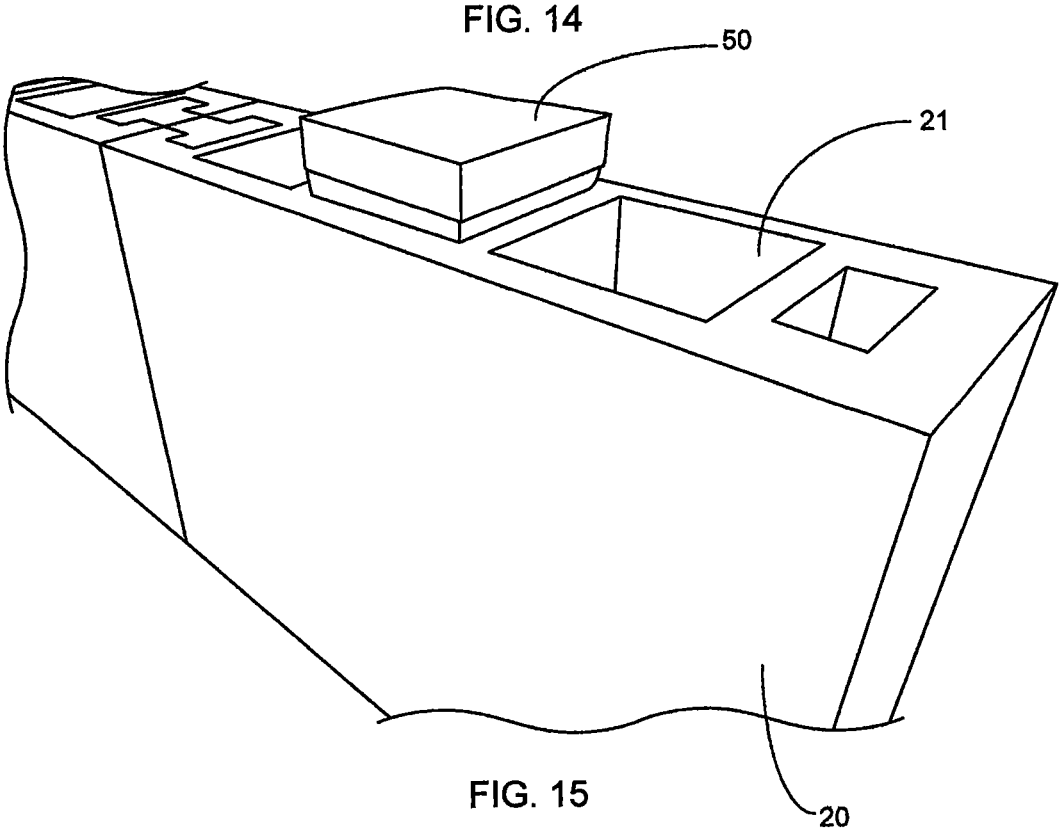
FIG. 15 is a top perspective view of a pour plug inserted into a cell of a wall panel.
Figure 16:
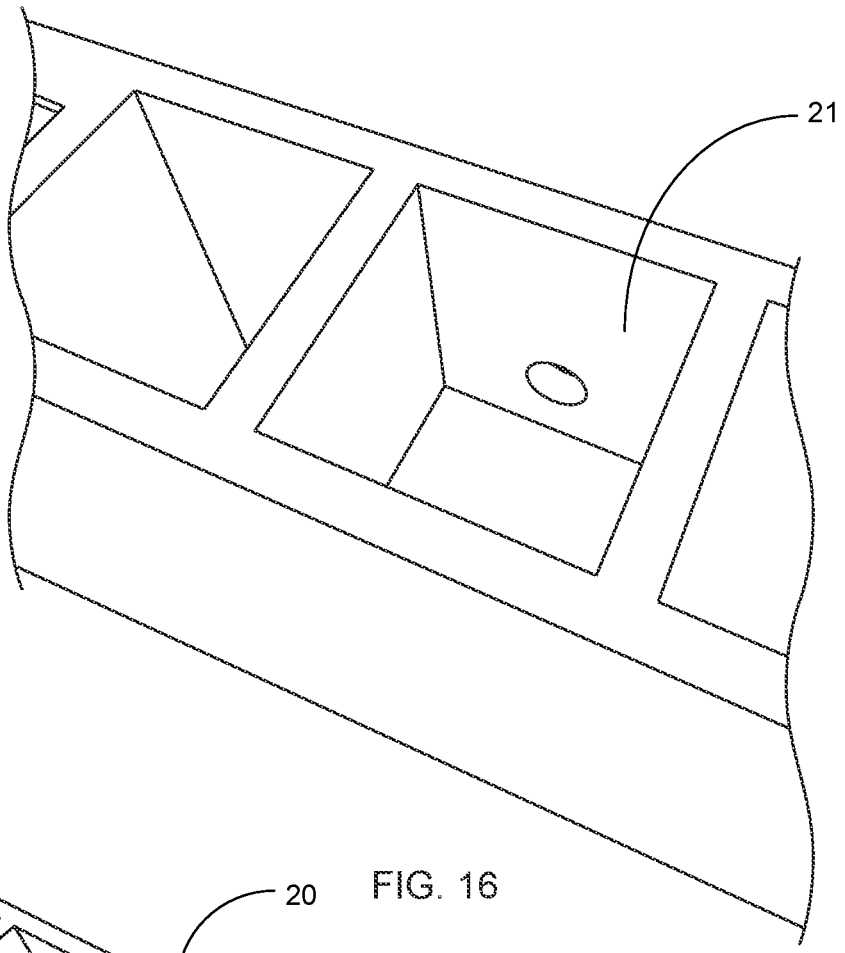
FIG. 16 is a detailed view of a cell of a wall panel of the present invention.
Figure 17:
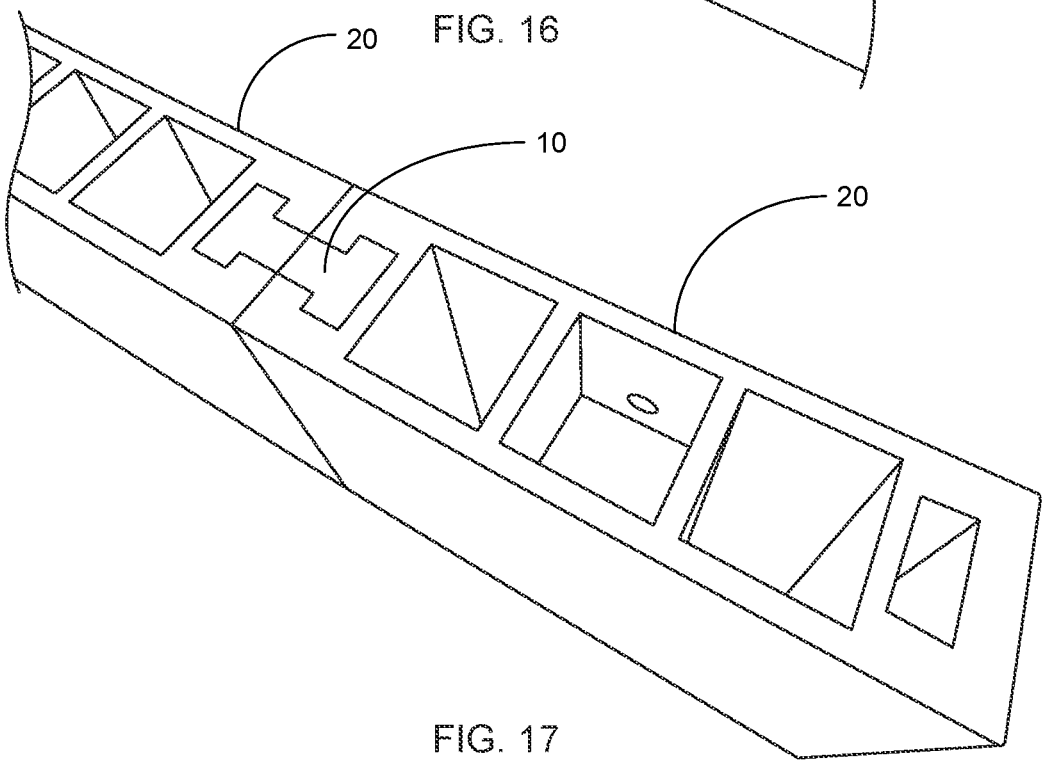
FIG. 17 is a top view of two adjoined wall panels being coupled with a wall connection spline.
Figure 18:
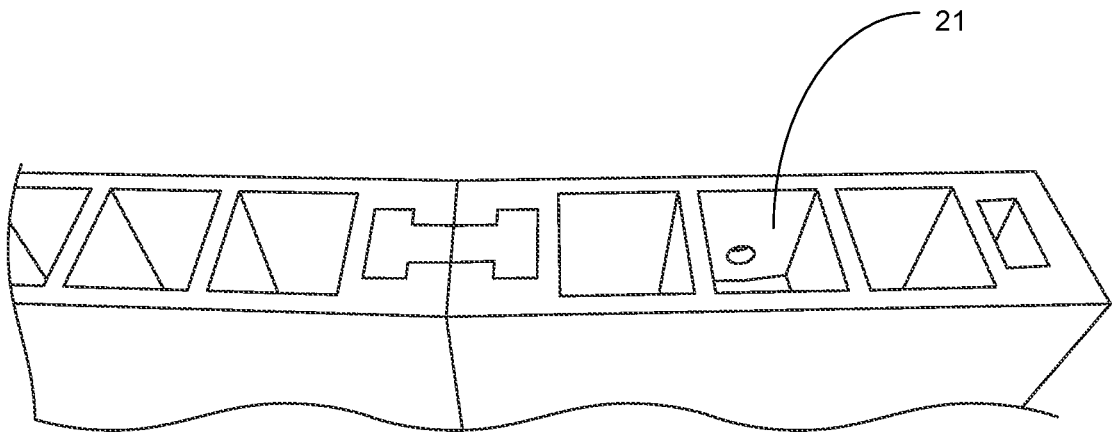
FIG. 18 is a top view of two adjoined wall panels being coupled with a wall connection spline.
Figure 19:
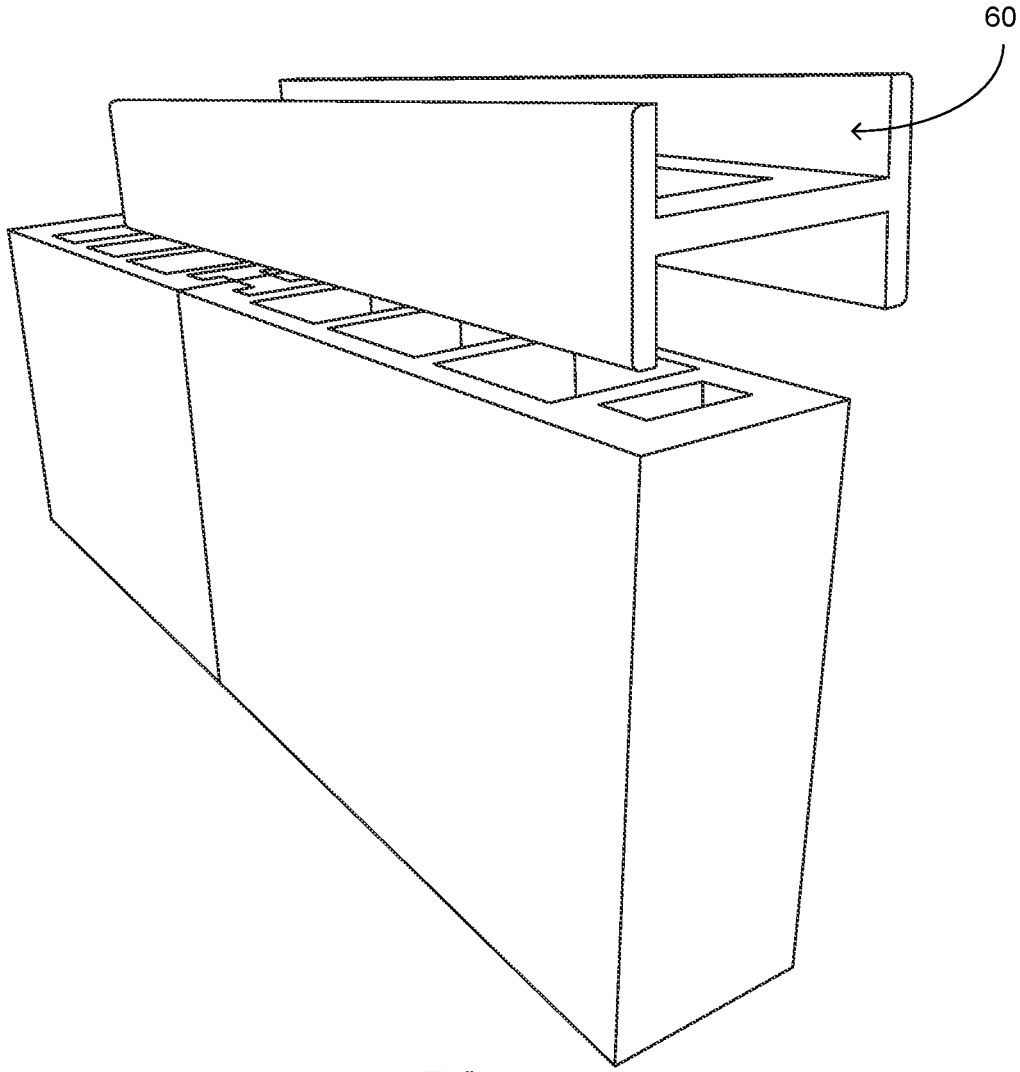
FIG. 19 is a end perspective view of a sub-cap section superposed a wall panel section.
Figure 20:
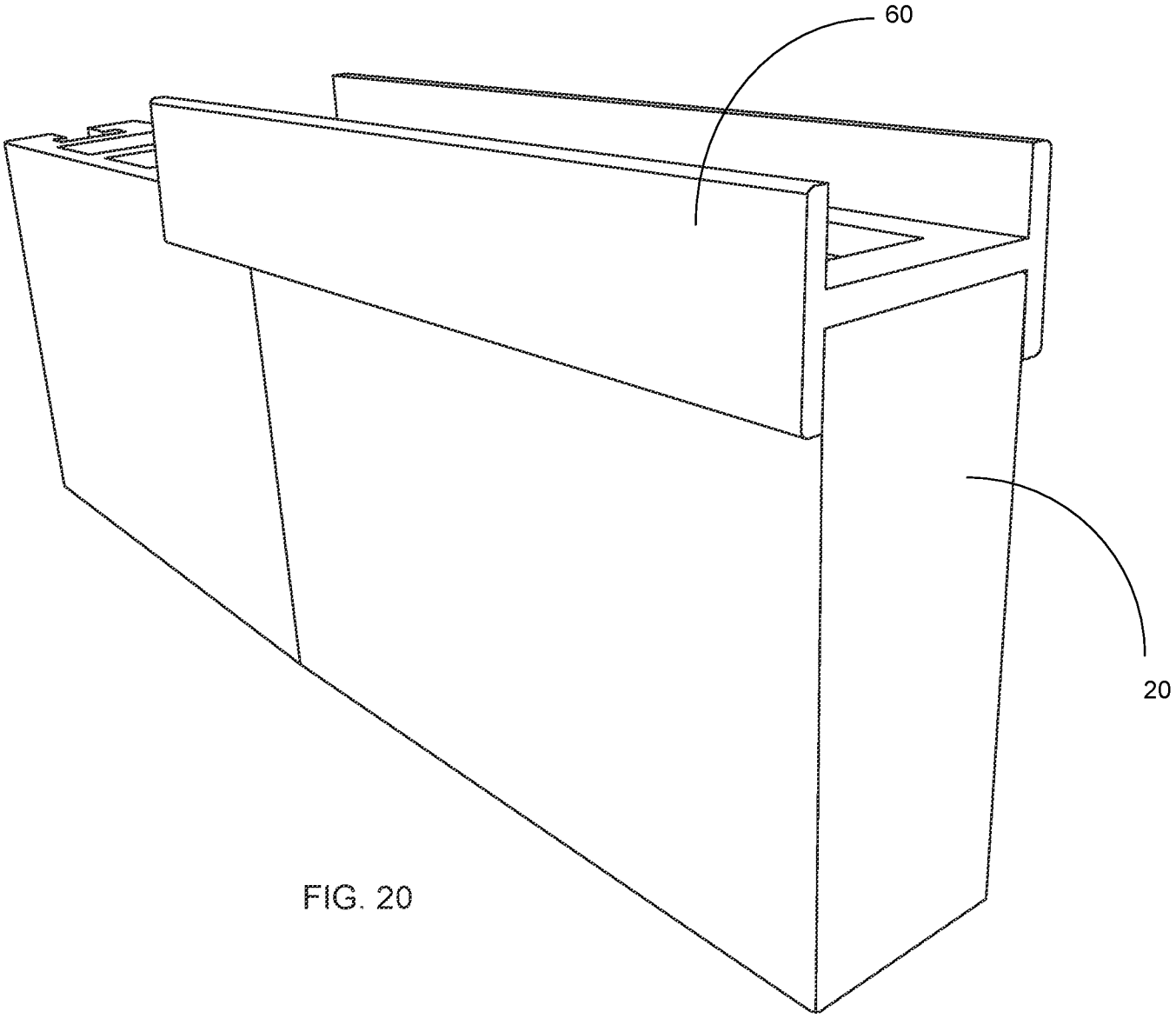
FIG. 20 is a end perspective view of a sub-cap section superposed a wall panel section.

FIG. 15 illustrates the plug member 50 of the present invention. The plug member 50 is configured to be operably inserted into cells 21. The plug member 50 is manufactured from a durable rigid material such as but not limited to plastic. The plug member 50 can be employed to either completely inhibit pouring of concrete into a cell or can be positioned near the lower edge 24 so as to provide a bottom to the cell 21 and allow the cell 21 to be filled with ultra high performance concrete. It should be understood that the plug member 50 is formed in a shape so as to be mateable with the cell 21. Furthermore, it should be understood that the plug member 50 could be positioned within the cell 21 anywhere intermediate the upper edge 23 and lower edge 24 of the wall panel member 20.

Figure 21:
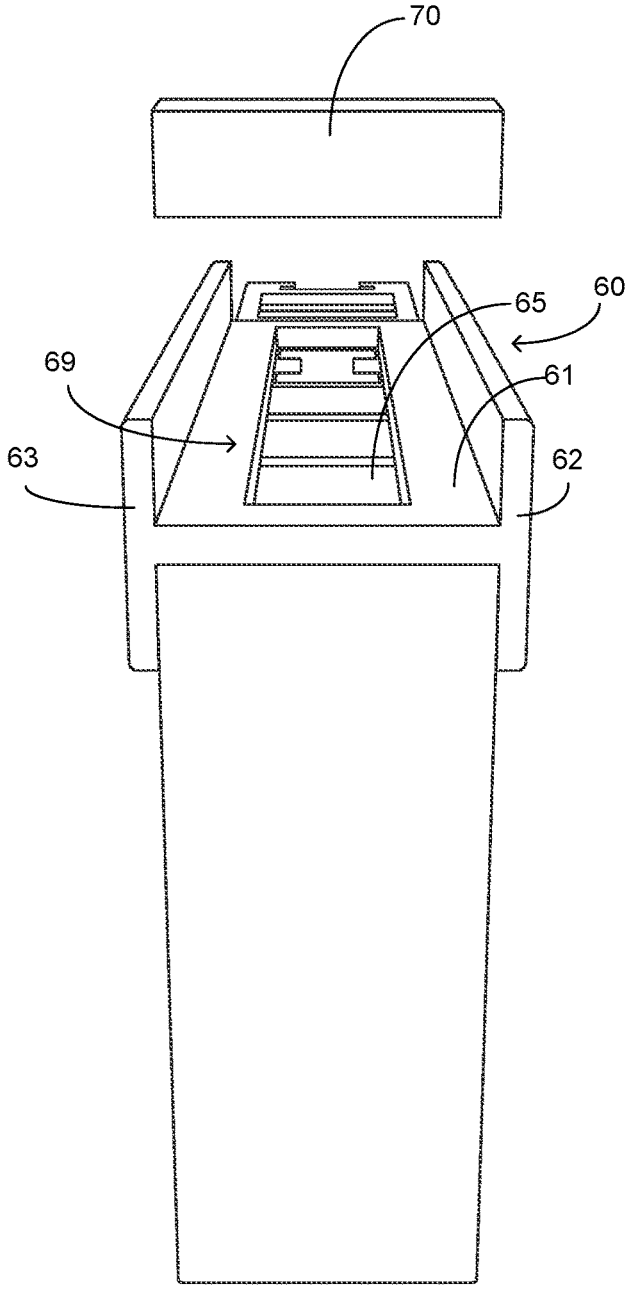
FIG. 21 is an end view of a wall panel having a sub-cap section superposed thereon with a pour block ready for positioning.
Figure 22:
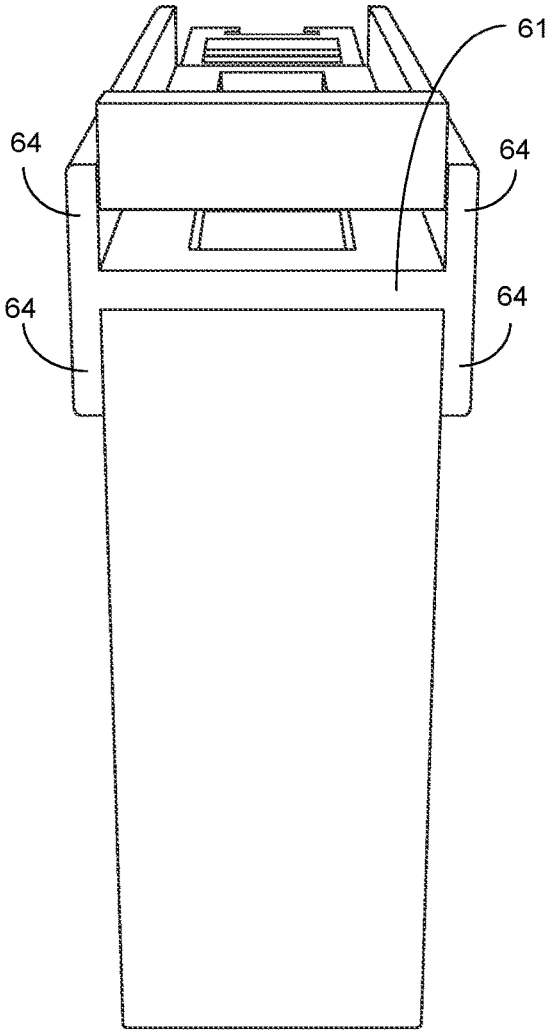
FIG. 22 is an end view of a wall panel having a sub-cap section superposed thereon with a pour block positioned at the end of the sub-cap section.
Figure 23:
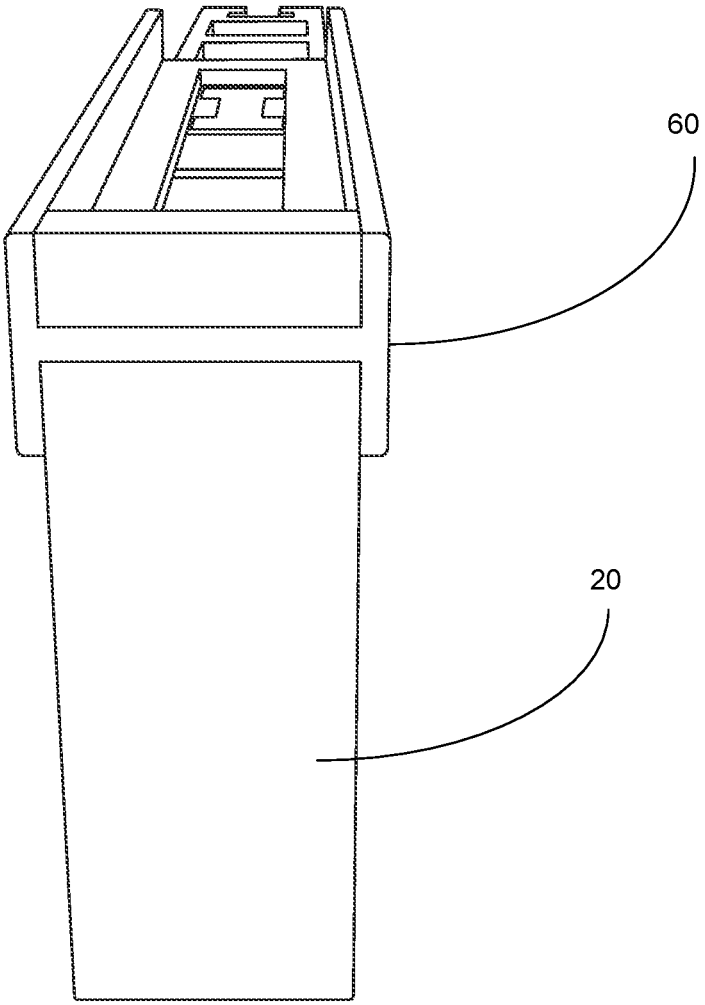
FIG. 23 is an end view of a wall panel having a sub-cap section superposed thereon with a pour block positioned at the end of the sub-cap section.

Referring to FIGS. 21 and 22 submitted herewith illustrate the sub-cap member 60 of the present invention. The sub-cap member 60 is configured to be superposed the wall panel members 10 ensuing placement thereof. The sub-cap member 60 is operable to provide a structural tie-in between the wall panel members 20 and the top cap member 70 ensuing a pour of ultra high performance concrete into the seawall 100. The sub-cap member 60 includes center portion 61 having first leg member 62 and second leg member 63 formed therewith on opposing sides thereof. The first leg member 62 and second leg member 63 are integrally formed with the center portion 61 being on opposing sides thereof. The first leg member 62 and second leg member 63 are perpendicular with the center portion 61 having sections 64 that extend both above and below the center portion 61. The width of the sub-cap member 60 is such that the sub-cap member 60 can be superposed the upper edge 23 of the wall panel member 20 wherein the sections 64 below the center portion 61 are adjacent the exterior surfaces of the wall panel member 20. The center portion 61 includes apertures 65 formed therein wherein the apertures 65 are of similar size and shape as the openings to the cells 21. During the pouring of ultra high performance concrete into the seawall 100 the apertures 65 facilitate the flow of concrete into the cells 21, which subsequent the filling thereof the concrete will fill the upper void 69 of the sub-cap member 60. Pour blocks 70 are secured to the ends of the sub-cap members 60 so as to provide containment of the poured ultra high performance concrete during the installation of the seawall 100.

Figure 24:
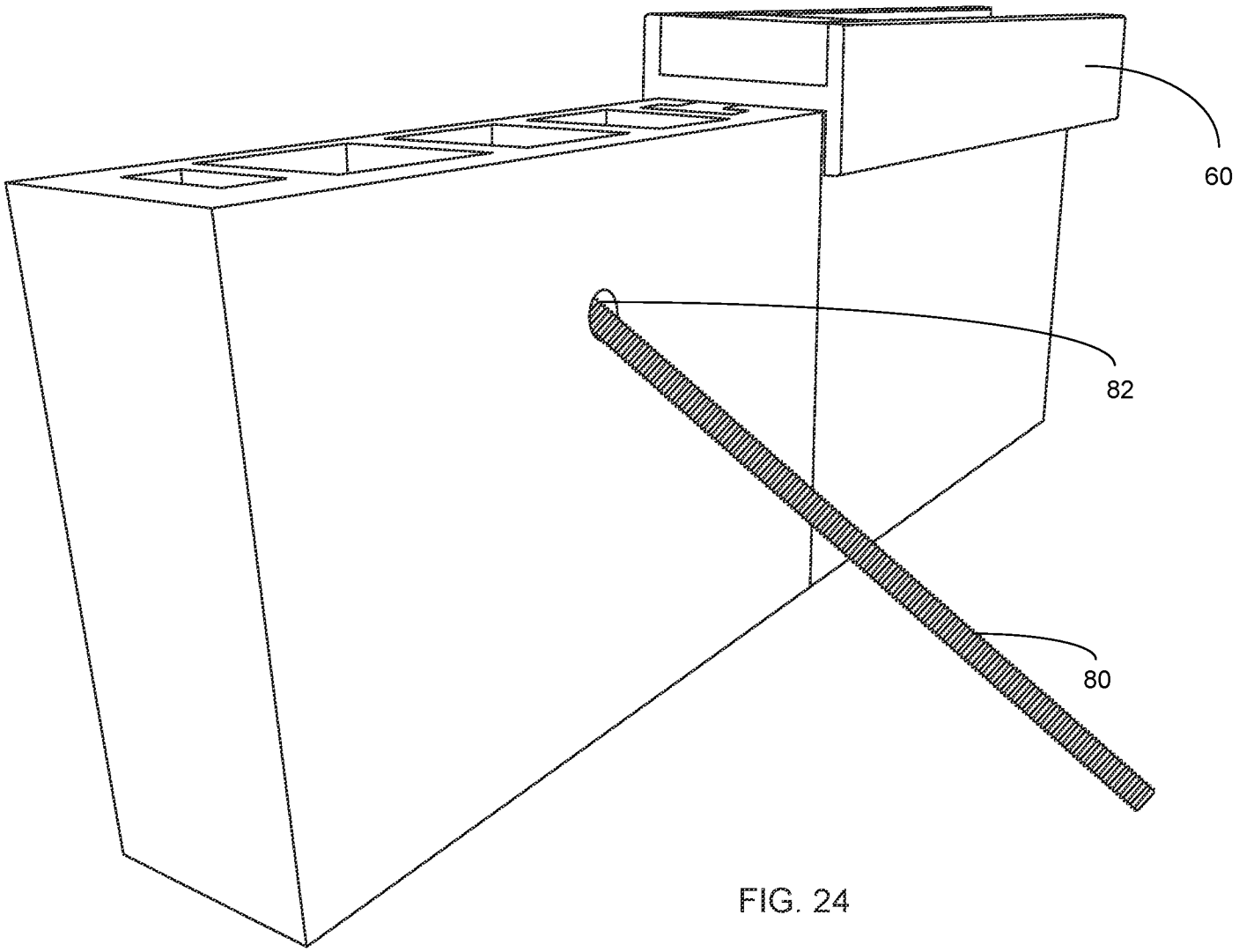
FIG. 24 is a rear view of a wall section having a tie rod extending outward therefrom.
Figure 25:
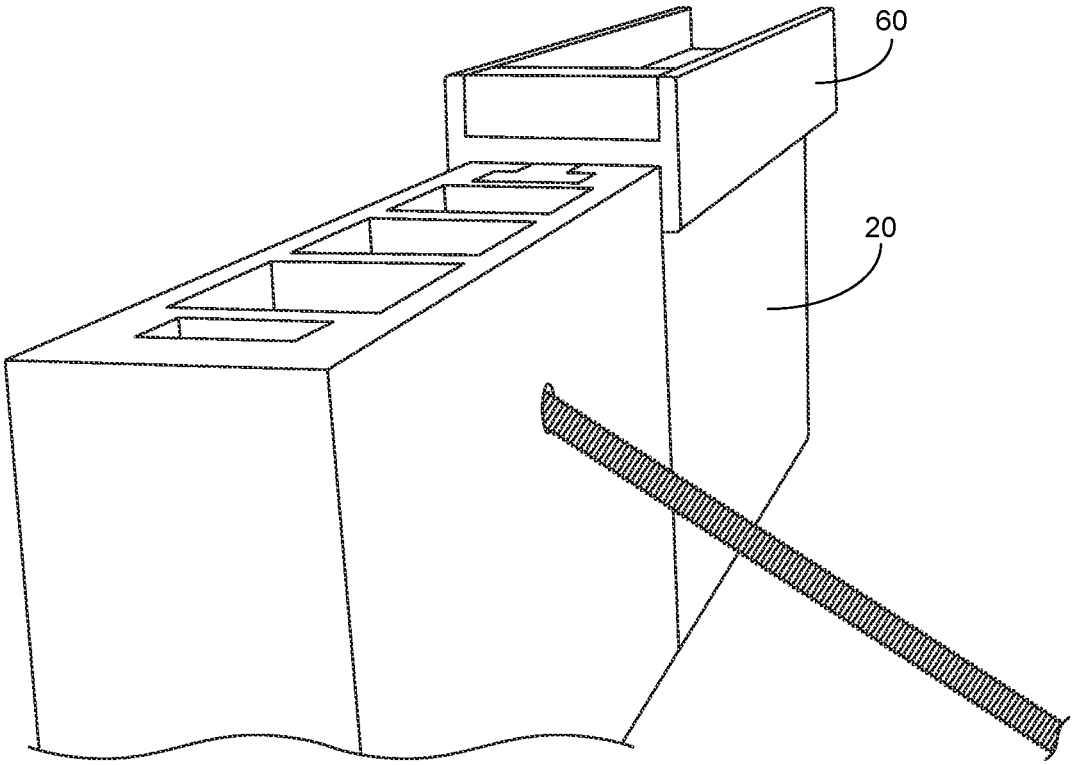
FIG. 25 is a rear view of a wall section having a tie rod extending outward therefrom.
Figure 26:
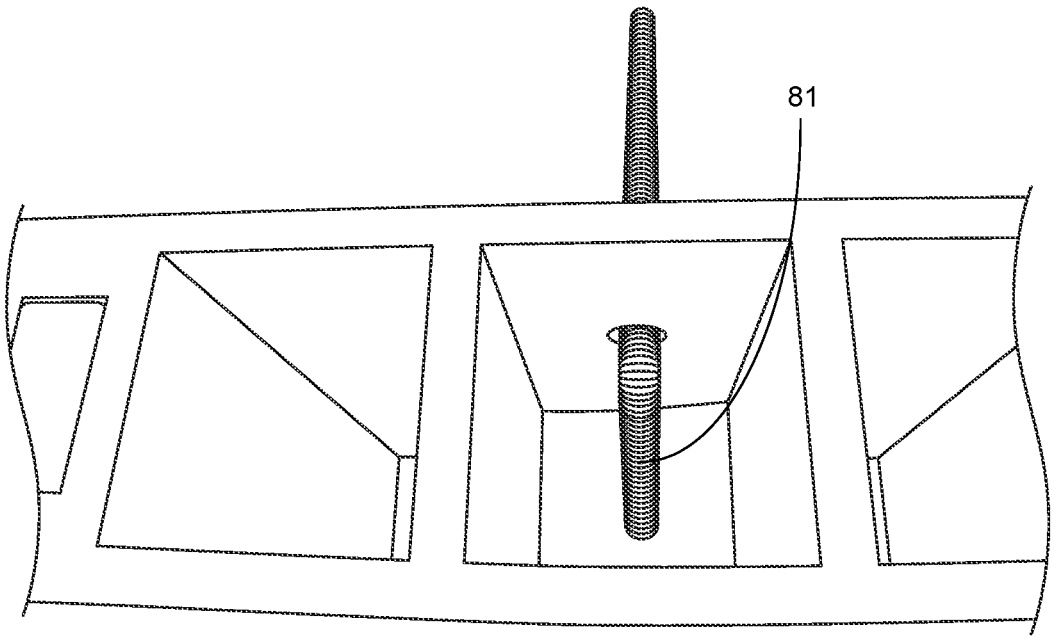
FIG. 26 is a top view of a wall section having a tie rod operably coupled thereto.
Figure 27:
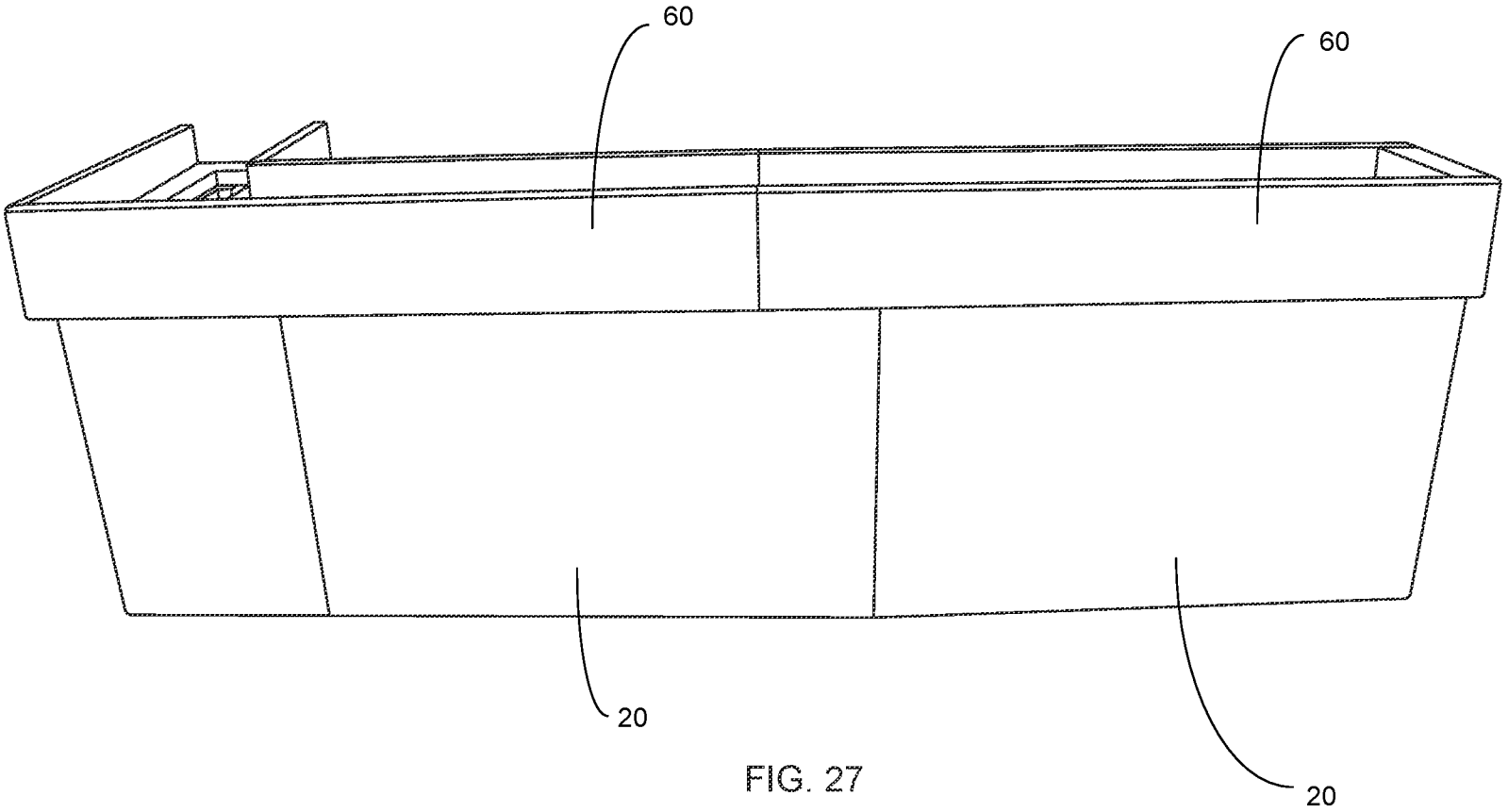
FIG. 27 is a perspective view of an exemplary section of the present invention with the wall panel and sub-cap section operably coupled.
Figure 28:
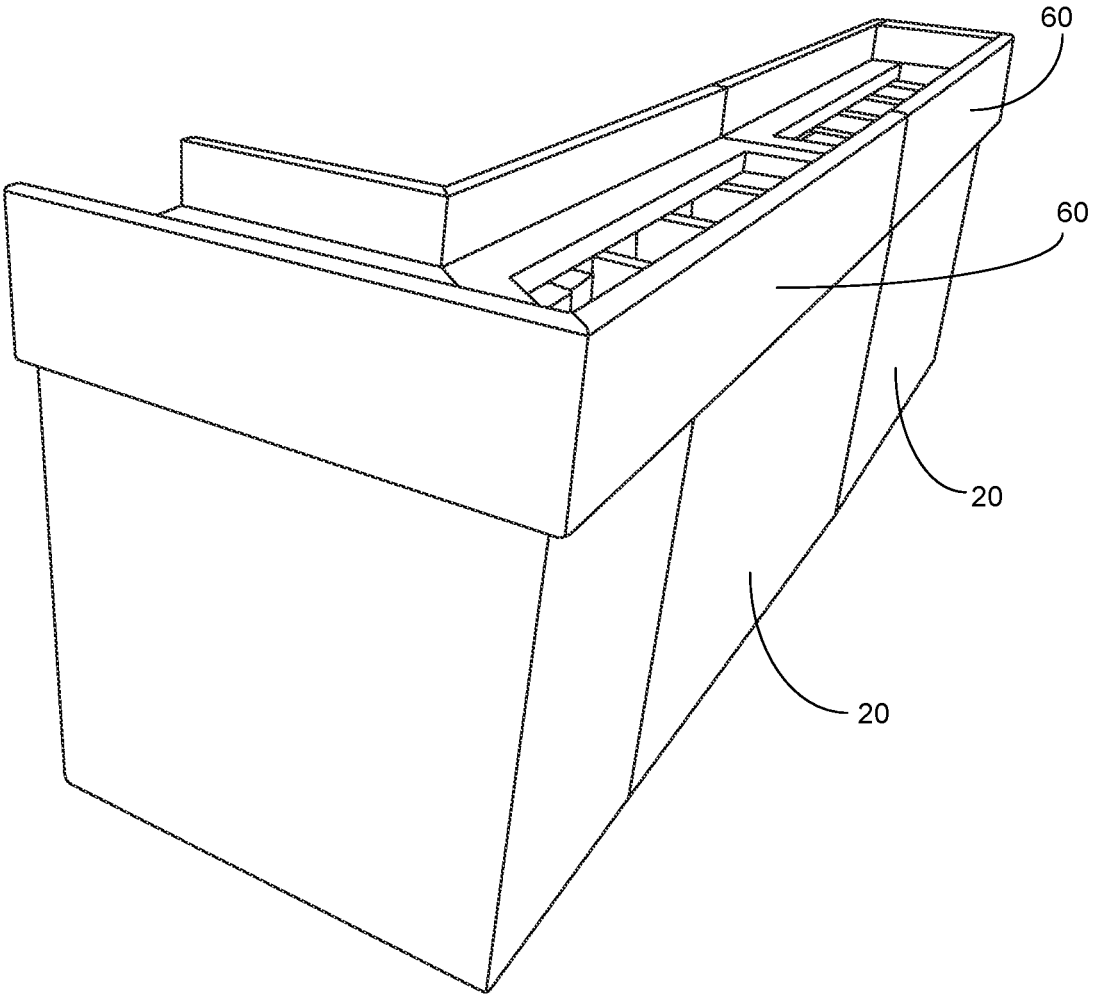
FIG. 28 is a top perspective view of wall panels of the present invention having the sub-cap section secured thereto.
Figure 29:
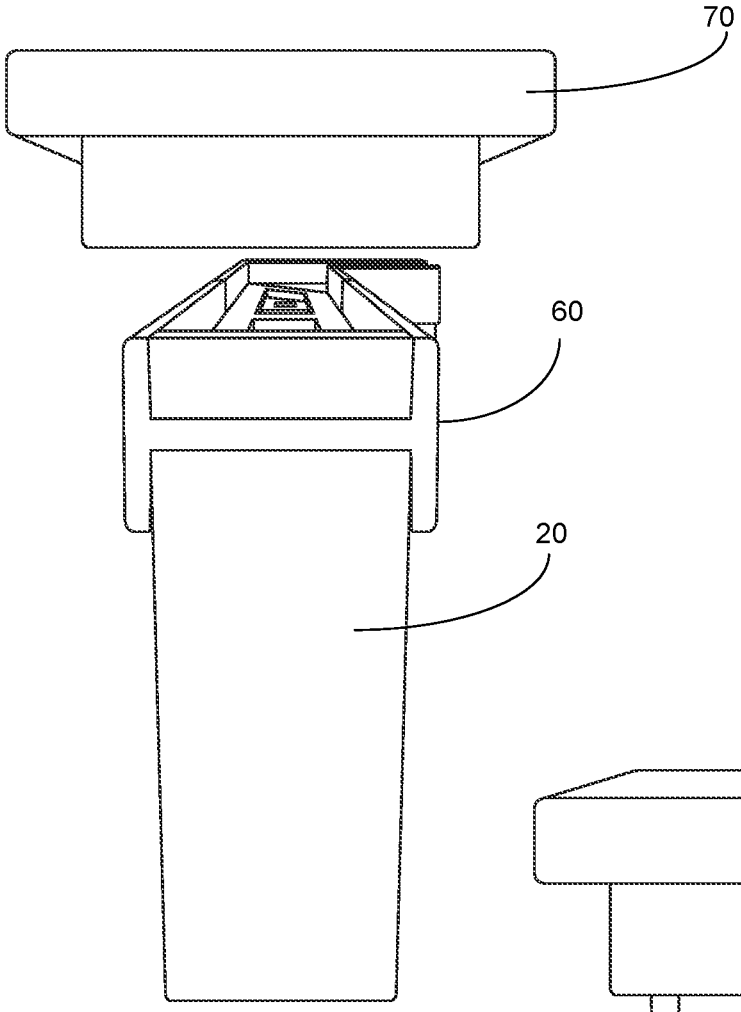
FIG. 29 is an end view of a top cap member in position above a wall panel for securing thereto.
Figure 30:
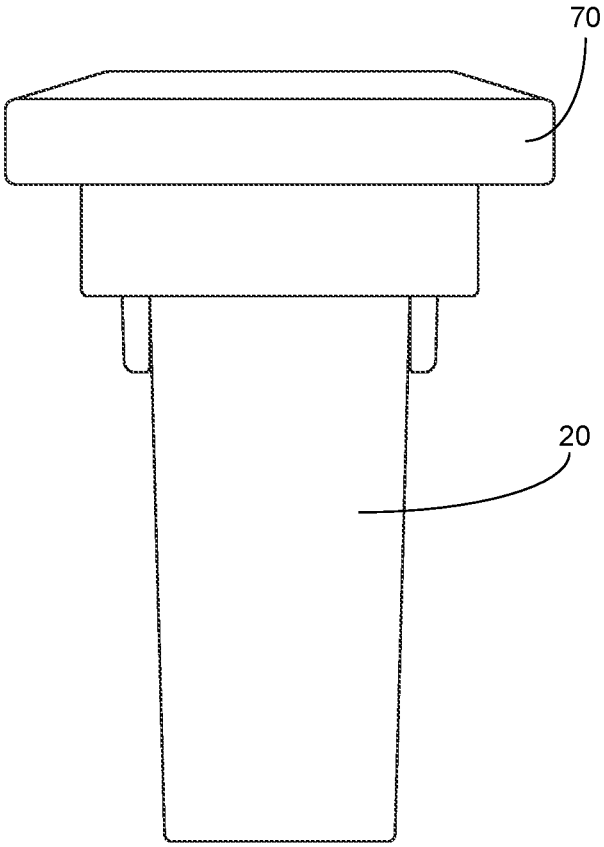
FIG. 30 is an end view of a top cap member secured to a wall panel.

Referring now to FIGS. 24 and 26, the seawall 100 includes tie-back rod 80. The tie-back rods 80 are manufactured from a durable material such as but not limited to metal. The tie-back rod 80 is configured to extend rearward from the wall panel members 20 and extend into the adjacent land so as to provide additional anchoring of the seawall 100. While not particularly illustrated herein it should be understood within the scope of the present invention that the tie-back rod 80 can include an anchor plate on the end thereof distal to the wall panel member 20 so as to bolster the securement to the land mass. The tie-back rod 80 is journaled through aperture 82 and includes section 81 that is disposed within the interior volume of the cell 21. The section 81 is oriented in a downwards direction and will be enveloped by the ultra high performance concrete during the pouring thereof towards the final step of installation of the seawall 100. It should be understood within the scope of the present invention that the tie-back rod 80 could be manufactured in alternate diameters and lengths as desired for the intended application of the seawall 100. It should be further understood within the scope of the present invention that the tie-back rods 80 could be installed in every wall panel member 20 or only a portion thereof.

Figure 31:
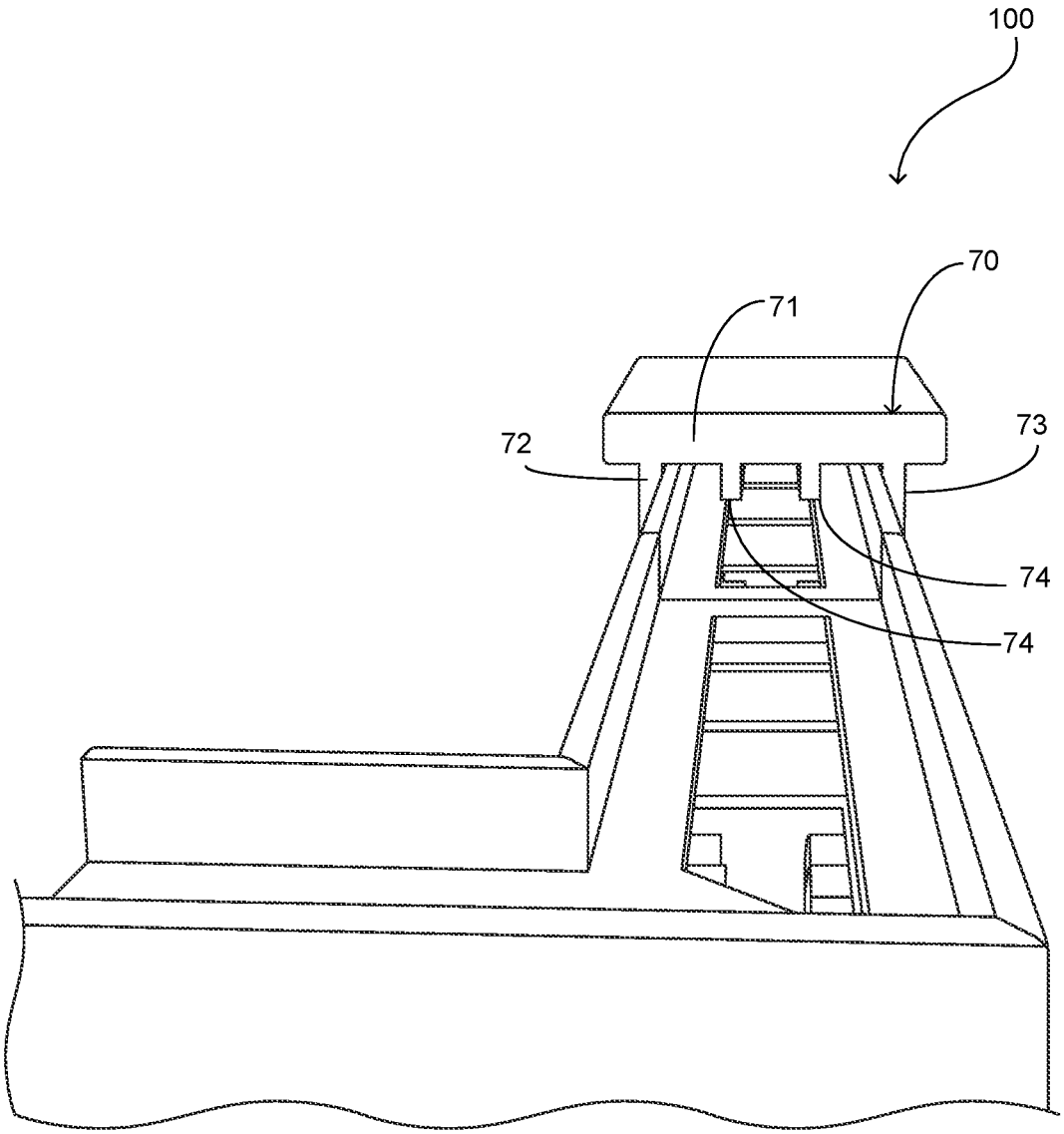
FIG. 31 is a top perspective view of a top cap member secured to a wall panel.
Figure 32:
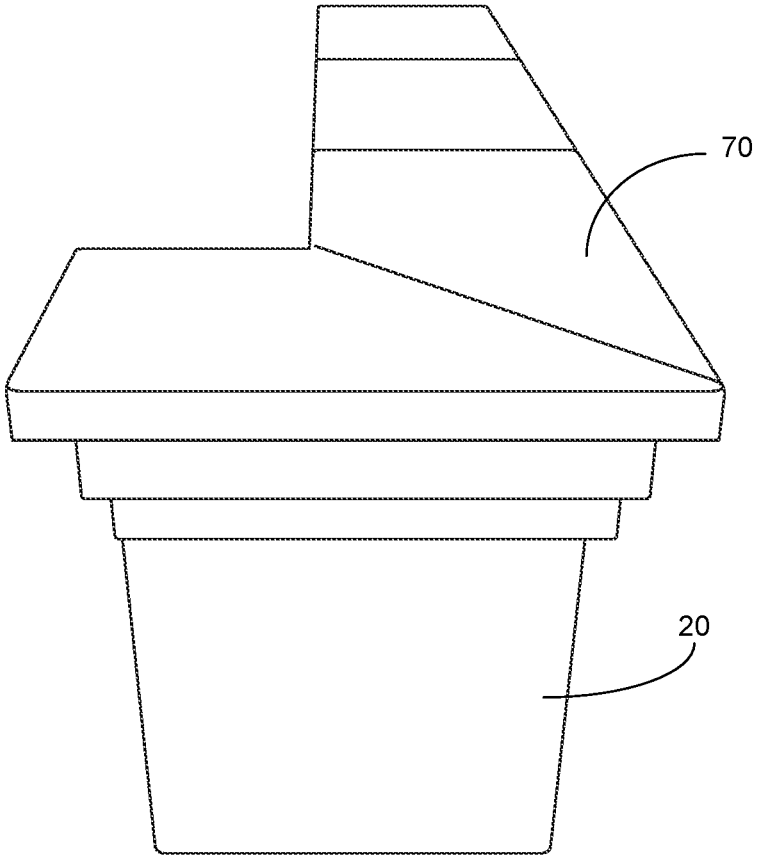
FIG. 32 is a top perspective view of an assembled portion of the seawall of the present invention.
Figure 33:
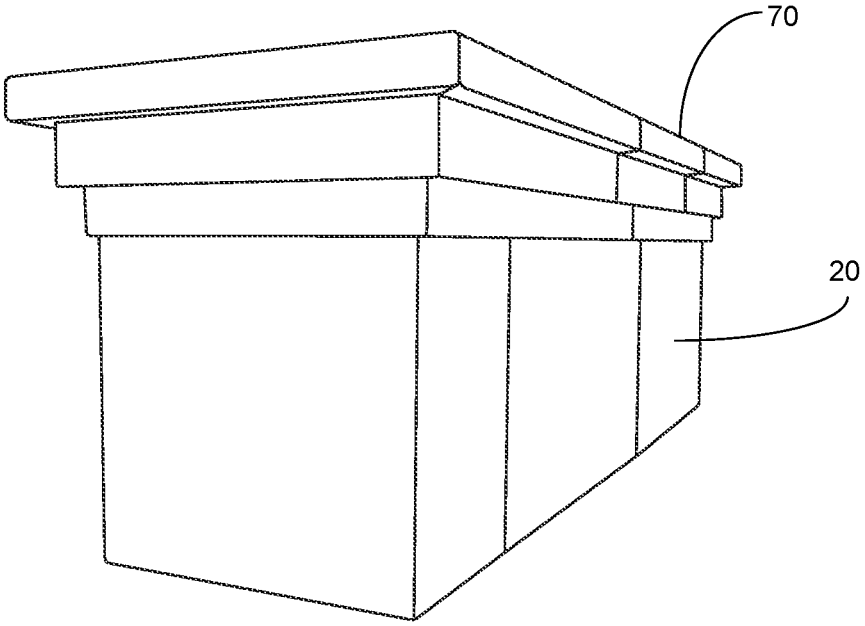
FIG. 33 is a front perspective view of an assembled portion of the seawall of the present invention.
Figure 34:
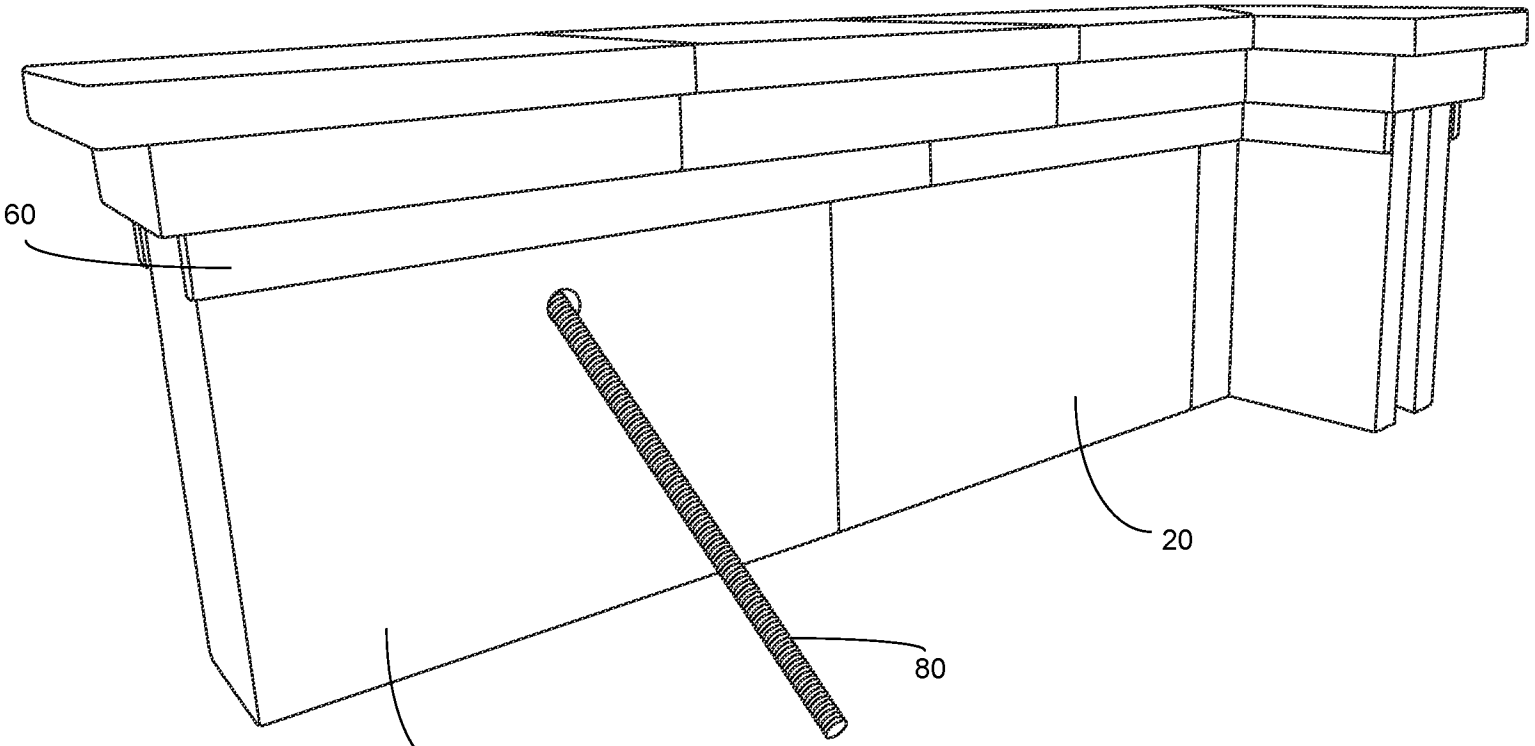
FIG. 34 is a rear perspective view of an assembled portion of the seawall of the present invention.

Referring now to FIG. 31, the top cap member 70 is illustrated therein. The top cap member 70 is configured to be mateably superposed the sub-cap member 60. The top cap member 70 is operably coupled to the sub-cap member 60 subsequent the pouring of the ultra high performance concrete but prior to the setting thereof. The top cap member includes upper portion 71 wherein the upper portion is perpendicular to the sub-cap member 60 and has a width that is greater than the sub-cap member 60. The top cap member 70 includes outer leg members 72, 73 wherein the outer leg members 72, 73 extend downward from the lower surface of the upper portion 71. The outer leg members 72, 73 are positioned so as to be adjacent the first leg member 62 and second leg member 63 of the sub-cap member 60. The top cap member 70 further includes inner leg member 74. The inner leg members 74 are positioned so as to be within the upper void 69 between the first leg member 62 and second leg member 63 and extend the length of the top cap member 70. The inner leg members 74 extend downward from the lower surface of the upper portion 71. The position of the inner leg members 74 provide engagement with the poured ultra high performance concrete that fills the upper void 69 which provides an integral coupling of the top cap member 70 resulting in a stronger connection of the top cap member 70 to the sub-cap member 60. It should be understood within the scope of the present invention that the inner leg members 74 could be formed in alternate shapes and sizes and achieve the desired objective as discussed herein. Furthermore, while two parallel inner leg members 74 are illustrated herein, it should be understood within the scope of the present invention that alternate quantities of inner leg members 74 could be present.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A seawall configured to be installed along a landmass edge adjacent to a body of water wherein the seawall comprises:

at least two wall panel members, said at least two wall panel members having a first end and a second end, said at least two wall panel members having an upper edge and a lower edge, said at least two wall panel members having a plurality of cells wherein the plurality of cells are hollow and extend intermediate the upper edge and lower edge, said plurality of cells having an opening proximate said upper edge, wherein said at least two wall panel members further include a connection void formed on at least one end thereof, said connection void extending between said upper edge and said lower edge of said at least two wall panel members, said connection void being hollow and having a mateable shape so as to couple to said wall panel connection member;

a wall panel connection member, said wall panel connection member being configured to be intermediate said at least two wall panel members, said wall panel connection member configured to operably couple said at least two wall panel members;

at least one piling member, said at least one piling member being elongated in shape, said at least one piling member having a first end and a second end, said at least one piling member being tapered at said second end, said at least one piling member configured to be inserted into one of said plurality of cells;

a sub-cap member, said sub-cap member configured to operably couple to said upper edge of said at least two wall panel members, said sub-cap member having a first end and a second end, said sub-cap member having a center portion wherein the center portion includes a plurality of apertures, said sub-cap member having a first leg member and a second leg member on opposing sides of said center portion, said first leg member and said second leg member being perpendicular to said center portion, said first leg member and said second leg member extending above an upper surface of said center portion so as to create a void, said apertures configured to be aligned with the openings of said plurality of cells so as to allow concrete to be poured therethrough, said void further being configured to retain concrete subsequent pouring thereof into the seawall, wherein said sub-cap member further includes a pour block, said pour block located at said first end of said sub-cap member and said second end of said sub-cap member, said pour block being placed on said upper surface of said center portion of said sub-cap member intermediate said first leg member and said second leg member;

a top cap member, said top cap member configured to be superposed said sub-cap member subsequent pouring of concrete into said at least two wall panel members and into the void of said sub-cap members, wherein said top cap member further includes an upper portion, said upper portion of said top cap member being perpendicular to said sub-cap member; and at least one plug member, said at least one plug member configured to be inserted into at least one of said plurality of cells, said at least one plug member moved to a position intermediate said upper edge and lower edge of said at least two wall panel members.

2. The seawall configured to be installed along the landmass edge adjacent to the body of water as recited in claim 1, wherein said at least one piling member includes a center section having a first lateral member and a second lateral member contiguous therewith and perpendicular thereto, said at least one piling member being formed so as to form a void intermediate an inner surface of said plurality of cells and said center section so as to allow concrete to be poured therearound.

3. The seawall configured to be installed along the landmass edge adjacent to the body of water as recited in claim 2, wherein said upper portion of said top cap member further include a first outer leg member and a second outer leg member extending downward therefrom, said first outer leg member and said second outer leg member configured to be adjacent an outer surface of opposing sides of said at least two wall panel members ensuing placement of said top cap member.

4. The seawall configured to be installed along the landmass edge adjacent to the body of water as recited in claim 3, and further including at least one tie-back rod, said at least one tie back rod having a portion configured to be placed within one of said plurality of cells, said at least one tie-back rod extending outward from said at least two wall panel members.

5. The seawall configured to be installed along the landmass edge adjacent to the body of water as recited in claim 4, wherein said top cap member further includes a first inner leg member and a second inner leg member extending downward from said upper portion of said top cap member, said first inner leg member and said second inner leg member configured to extend into said void of said sub-cap member.

6. The seawall configured to be installed along the landmass edge adjacent to the body of water as recited in claim 5, wherein said connection void is T-shaped.

7. A seawall configured to be installed along a landmass edge adjacent to a body of water and have concrete poured thereinto subsequent installation of the seawall wherein the seawall comprises:

a plurality of wall panel members, said plurality of wall panel members having a first end and a second end, said plurality of wall panel members further having a first side and a second side, said plurality of wall panel members having an upper edge and a lower edge, said plurality of wall panel members having a plurality of cells wherein the plurality of cells are hollow and extend intermediate the upper edge and lower edge, said plurality of cells having an opening proximate said upper edge, said plurality of wall panel members further having a connection void on said first end thereof, said connection void extending between said upper edge and said lower edge, said connection void being hollow having a center section and a cross section, said cross section being integrally formed with said center section and perpendicular thereto;

a plurality of wall panel connection members, said plurality of wall panel connection members being configured to operably couple said plurality of wall panel members, said plurality of wall panel connection members mateably shaped with said connection void so as to be inserted thereinto;

a plurality of piling members, said plurality of piling members being elongated in shape, said plurality of piling members having a first end and a second end, said plurality of piling members being tapered at said second end, said plurality of piling members configured to be inserted into some of said plurality of cells, wherein said plurality of piling members further include a center section, said center section being planar in manner having a first lateral member and a second lateral member on opposing sides thereof, said first lateral member and said second lateral member being perpendicular to said center section of said plurality of piling members, said center section, said first lateral member and said second lateral member creating a first void and a second void between inner surface of said plurality of cells so as to allow concrete to be poured therearound;

a sub-cap member, said sub-cap member configured to operably couple to said upper edge of said at least two wall panel members, said sub-cap member having a first end and a second end, said sub-cap member having a center portion wherein the center portion includes a plurality of apertures, said sub-cap member having a first leg member and a second leg member on opposing sides of said center portion, said first leg member and said second leg member being perpendicular to said center portion, said first leg member and said second leg member extending above an upper surface of said center portion so as to create a void, said first leg member and said second leg member further having portions extending downward from said center portion wherein said portions of said first leg member and said second leg member are adjacent said first side and said second side of said plurality of wall panel members, said apertures of said center portion configured to be aligned with the openings of said plurality of cells so as to allow concrete to be poured therethrough, said void further being configured to retain concrete subsequent pouring thereof into the seawall, wherein said sub-cap member further includes a pour blocks, said pour blocks being rectangular in shape and located at said first end of said sub-cap member and said second end of said sub-cap member, said pour blocks being placed on said upper surface of said center portion of said sub-cap member intermediate said first leg member and said second leg member;

a top cap member, said top cap member configured to be superposed said sub-cap member subsequent pouring of concrete into said at least two wall panel members and into the void of said sub-cap members, said top cap member having an upper portion wherein said upper portion of said top cap member is perpendicular to said sub-cap member, wherein said upper portion of said top cap member further includes a first outer leg member and a second outer leg member extending downward therefrom, said first outer leg member and said second outer leg member configured to be adjacent an outer surface of said first side and said second side of said plurality of wall panel members ensuing placement of said top cap member and wherein said top cap member further includes a first inner leg member and a second inner leg member extending downward from said upper portion of said top cap member, said first inner leg member and said second inner leg member configured to extend into said void of said sub-cap member; and at least one plug member, said at least one plug member configured to be inserted into at least one of said plurality of cells, said at least one plug member moved to a position intermediate said upper edge and lower edge of said plurality of wall panel members.

8. The seawall configured to be installed along the landmass edge adjacent to the body of water and have concrete poured thereinto subsequent installation thereof as recited in claim 7, wherein said plurality of wall panels further include one aperture journaled through the second side thereof, said aperture configured to penetrate into one of said plurality of cells.

9. The seawall configured to be installed along the landmass edge adjacent to the body of water and have concrete poured thereinto subsequent installation thereof as recited in claim 8, and further including at least one tie-back rod, said at least one tie back rod having a portion configured to be placed within one of said plurality of cells and journaled through said one aperture of said plurality of wall panel members, said at least one tie-back rod extending outward from said second side of said plurality of said wall panel members.

10. The seawall configured to be installed along the landmass edge adjacent to the body of water and have concrete poured thereinto subsequent installation thereof as recited in claim 9, wherein said plurality of wall connection panels further include a center portion, said center portion having formed on opposing lateral edges a first lateral support member and a second lateral support member, said first lateral support member and said second lateral support member being perpendicular to said center portion.

11. The seawall configured to be installed along the landmass edge adjacent to the body of water and have concrete poured thereinto subsequent installation thereof as recited in claim 10, wherein said plurality of cells and said void of said sub-cap member are filled with ultra-high performance concrete ensuing placement thereof.

* * * * *